US007012587B2

(12) United States Patent
Satoh et al.

(10) Patent No.: US 7,012,587 B2
(45) Date of Patent: Mar. 14, 2006

(54) MATRIX DISPLAY DEVICE, MATRIX DISPLAY DRIVING METHOD, AND MATRIX DISPLAY DRIVER CIRCUIT

(75) Inventors: Shinichi Satoh, Tokyo (JP); Shinichi Fukuzako, Kanagawa (JP); Junji Kashiwada, Tokyo (JP); Kenji Kokuda, Saitama (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 584 days.

(21) Appl. No.: 10/172,979

(22) Filed: Jun. 18, 2002

(65) Prior Publication Data

US 2003/0043127 A1 Mar. 6, 2003

(30) Foreign Application Priority Data

Aug. 30, 2001 (JP) ..... 2001/260918

(51) Int. Cl.
*G09G 3/32* (2006.01)

(52) U.S. Cl. ..... 345/82

(58) Field of Classification Search ..... 345/76, 345/77, 79–80, 87–89, 100, 204, 82, 55, 345/96; 327/94, 111; 315/169.1, 169.3, 315/169.4

See application file for complete search history.

(56) References Cited

U.S. PATENT DOCUMENTS 4,652,872 A * 3/1987 Fujita ..... 345/78
4,967,100 A * 10/1990 Okutsu et al. ..... 327/111
5,517,207 A * 5/1996 Kawada et al. ..... 345/78
5,838,289 A * 11/1998 Saito et al. ..... 345/79
6,323,851 B1 * 11/2001 Nakanishi ..... 345/211
6,847,193 B1 * 1/2005 Sakuragi ..... 320/166

FOREIGN PATENT DOCUMENTS

JP 11143429 5/1999
JP 11305728 11/1999

* cited by examiner

*Primary Examiner*—Chanh Nguyen
(74) *Attorney, Agent, or Firm*—Rabin & Berdo, P.C.

(57) ABSTRACT

A display device comprises a plurality of first to fourth switching elements. On the basis of control signals from the drive control circuit, the common line is brought to the selected state when the common line is connected to the low-voltage portion for common lines by turning on the first switching element and turning off the second switching element; the common line is brought to the non-selected state when the common line is brought to the high-impedance state by turning off both the first and second switching elements; the data line is brought to the selected state when the data line is connected to the high-voltage portion for data lines by turning off the third switching element and turning on the fourth switching element; and the data line is brought to the non-selected state when the data line is connected to the low-voltage portion for data lines by turning on the third switching element and turning off the fourth switching element.

33 Claims, 30 Drawing Sheets

FIRST EMBODIMENT

FIRST EMBODIMENT

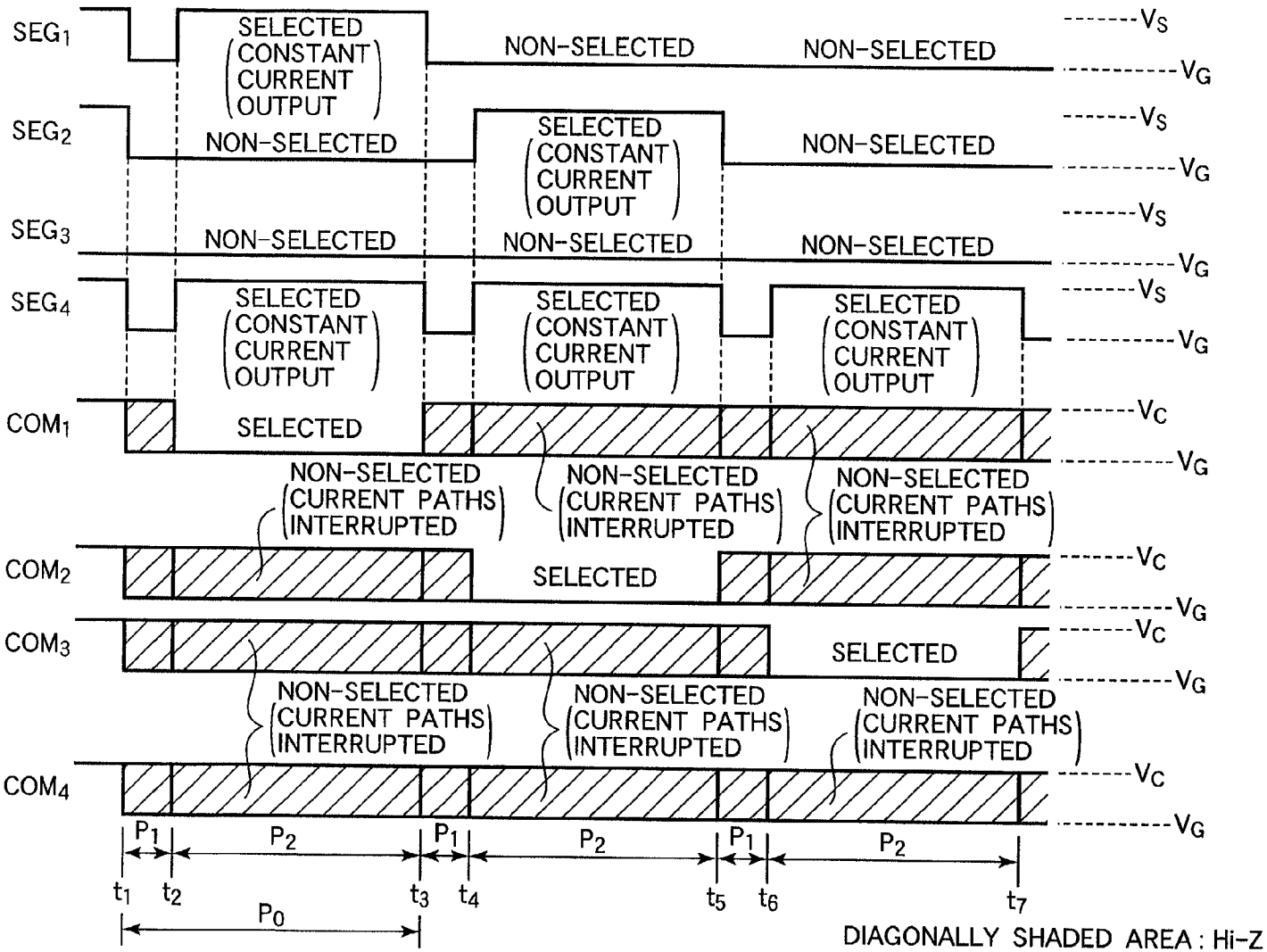
FIG.2 OPERATION (1) OF FIRST EMBODIMENT

OPERATION (1) OF FIRST EMBODIMENT
AT t2
AT t3
AT t4
SEG1
COM1
COM2
COM3
COM4
PE1,1
PE1,2
PE1,3
PE1,4
VG
VC
VS
ON
OFF
ON→OFF
OFF→ON

COM1
COM2
COM3
COM4
SEG1
AT t2
AT t3
AT t4
COMPARISON EXAMPLE
I11
I12
I13
I14
I22
I23
I24
I32
I33
I34
I42
I43
I44
VG
VC
VS
ON
OFF
ON→OFF
OFF→ON

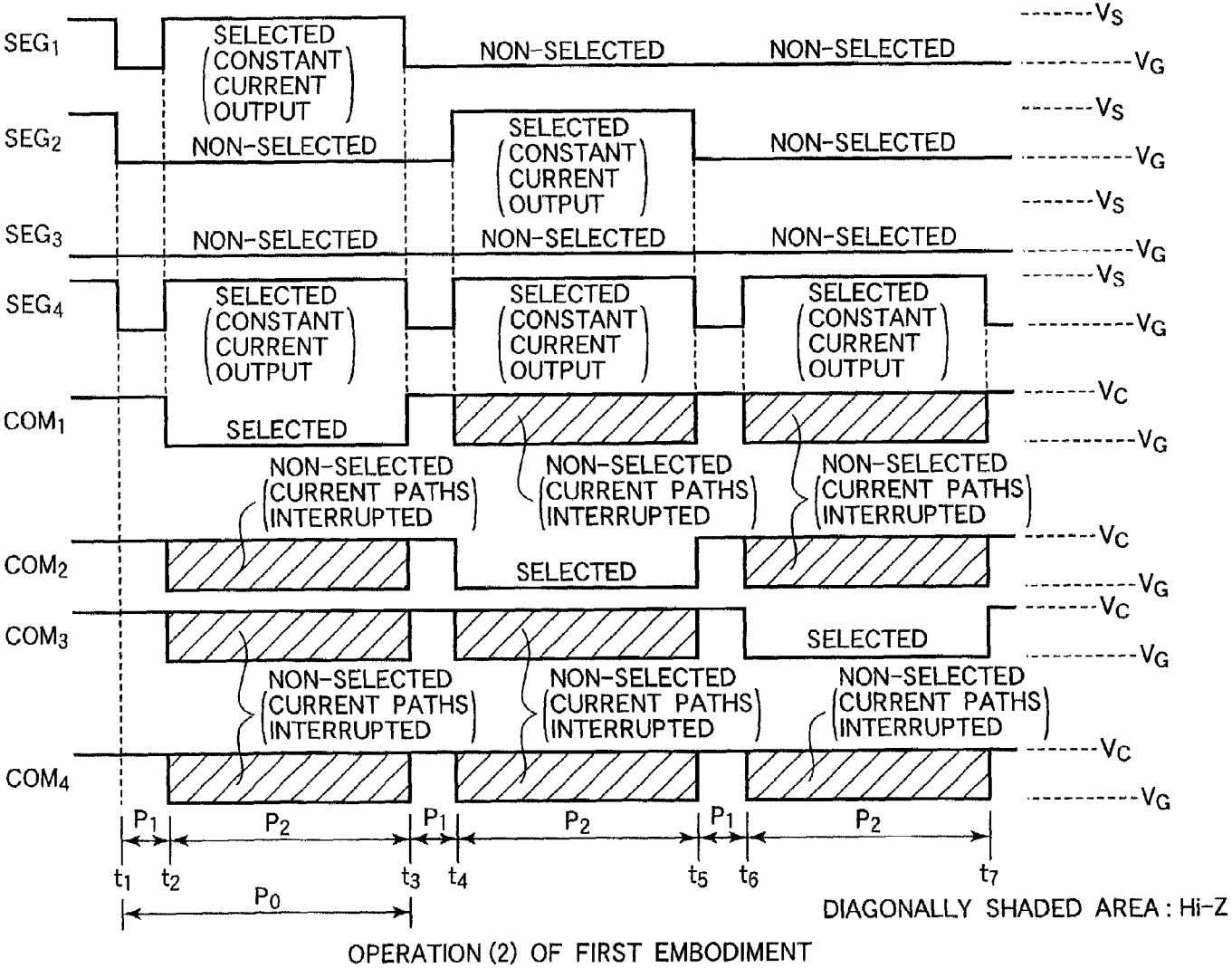
FIG.5 OPERATION (2) OF FIRST EMBODIMENT

OPERATION (2) OF FIRST EMBODIMENT
AT t2
AT t3
AT t4
SEG1
COM1
COM2
COM3
COM4
PE1,1
PE1,2
PE1,3
PE1,4
VG
VC
VS
ON
OFF
ON→OFF
OFF→ON

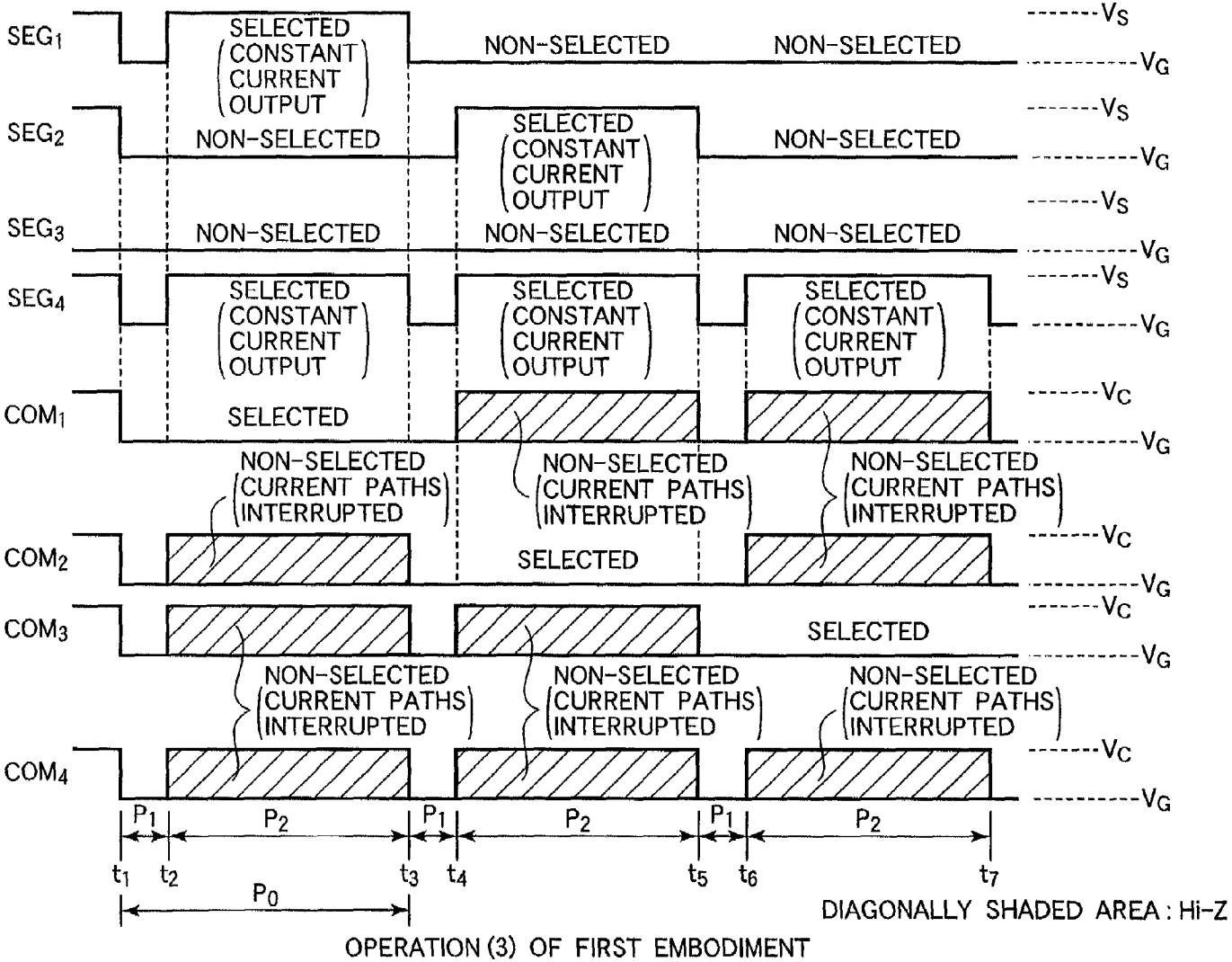
FIG.7 OPERATION (3) OF FIRST EMBODIMENT

OPERATION (3) OF FIRST EMBODIMENT
AT $t_2$
AT $t_3$
AT $t_4$
$SEG_1$
$COM_1$
$COM_2$
$COM_3$
$COM_4$
$PE_{1,1}$
$PE_{1,2}$
$PE_{1,3}$
$PE_{1,4}$
$V_G$
$V_S$
$V_C$
ON
OFF
ON→OFF
OFF→ON
$34_1$
$32_1$
$33_1$
$22_1$
$23_1$
$24_1$
$22_2$
$23_2$
$24_2$
$22_3$
$23_3$
$24_3$
$22_4$
$23_4$
$24_4$

OPERATION (4) OF FIRST EMBODIMENT (d)
OPERATION (4) OF FIRST EMBODIMENT
AT $t_{11}$
AT $t_{12}$
AT $t_{13}$
AT $t_{14}$
$SEG_1$
$COM_1$
$COM_2$
$COM_3$
$COM_4$
$PE_{1,1}$
$PE_{1,2}$
$PE_{1,3}$
$PE_{1,4}$
$V_G$ $V_S$
$V_G$ $V_C$
OFF→ON
ON→OFF

SECOND EMBODIMENT

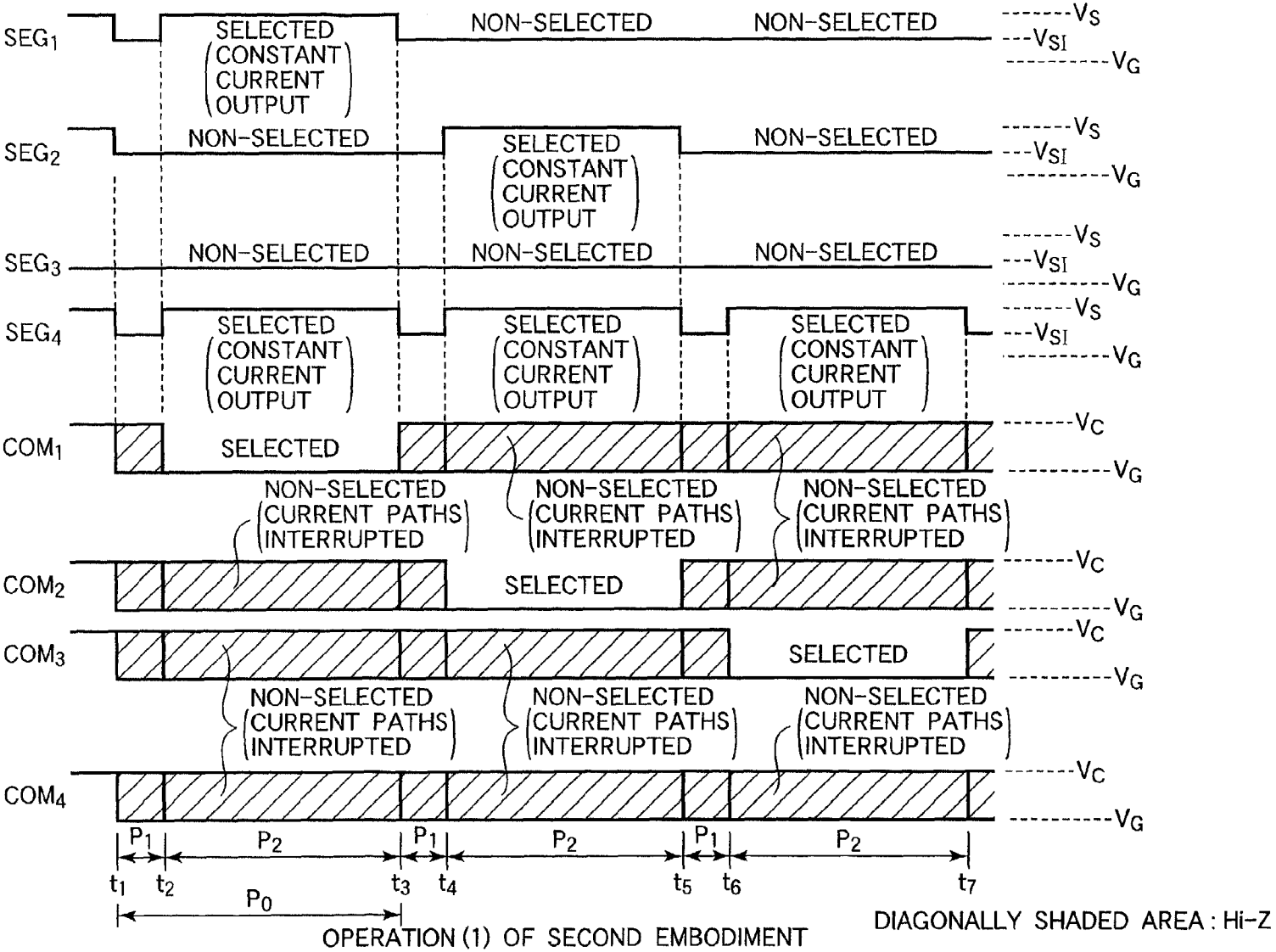
FIG.12 OPERATION (1) OF SECOND EMBODIMENT

OPERATION (1) OF SECOND EMBODIMENT
AT t2
AT t3
AT t4
SEG1
COM1
COM2
COM3
COM4
PE1,1
PE1,2
PE1,3
PE1,4
VSI
VS
VG
VC
ON
OFF
ON→OFF
OFF→ON

OPERATION (2) OF SECOND EMBODIMENT
AT t2
AT t3
AT t4
SEG1
COM1
COM2
COM3
COM4
PE1,1
PE1,2
PE1,3
PE1,4
VSI VS
VG VC
ON→OFF
OFF→ON
ON
OFF

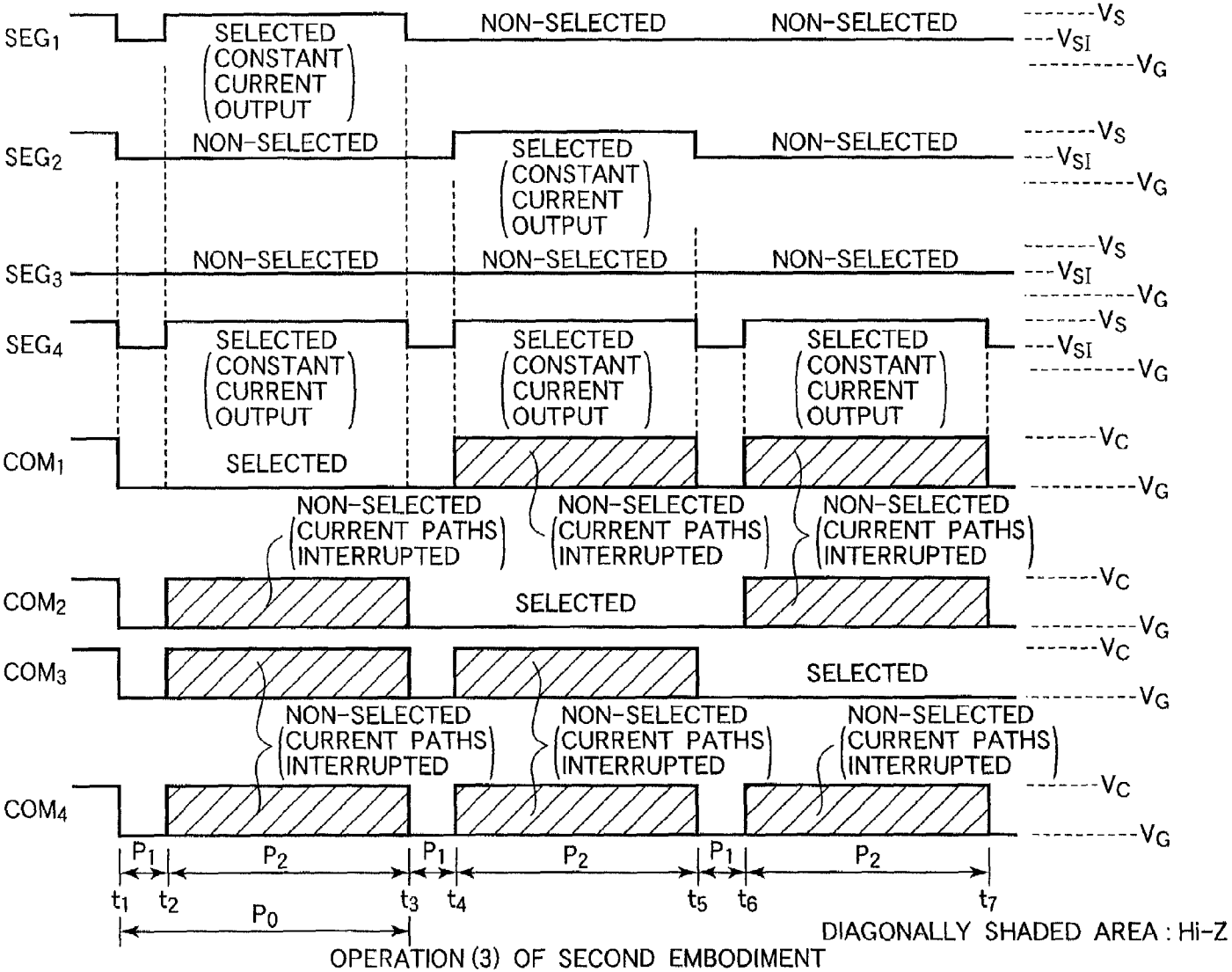
FIG.16 OPERATION (3) OF SECOND EMBODIMENT

OPERATION (3) OF SECOND EMBODIMENT
AT t2
AT t3
AT t4
SEG1
COM1
COM2
COM3
COM4
PE1,1
PE1,2
PE1,3
PE1,4
VSI
VS
VG
VC
ON
OFF
ON→OFF
OFF→ON

OPERATION (4) OF SECOND EMBODIMENT

OPERATION (4) OF SECOND EMBODIMENT
AT $t_{11}$
AT $t_{12}$
AT $t_{13}$
AT $t_{14}$
$SEG_1$
$COM_1$
$COM_2$
$COM_3$
$COM_4$
$PE_{1,1}$
$PE_{1,2}$
$PE_{1,3}$
$PE_{1,4}$
$V_{SI}$ $V_S$
$V_G$ $V_C$
ON
OFF
OFF→ON
ON→OFF

THIRD EMBODIMENT

OPERATION OF THIRD EMBODIMENT

OPERATION OF THIRD EMBODIMENT
AT $t_2$
AT $t_3$
AT $t_4$
$SEG_1$
$COM_1$
$COM_2$
$COM_3$
$COM_4$
$PE_{1,1}$
$PE_{1,2}$
$PE_{1,3}$
$PE_{1,4}$
$V_G$
$V_{CI}$
$V_{SI}$
$V_S$
ON
OFF
ON→OFF
OFF→ON

FOURTH EMBODIMENT

OPERATION OF FOURTH EMBODIMENT

OPERATION OF FOURTH EMBODIMENT
AT t2
AT t3
AT t4
SEG1
COM1
COM2
COM3
COM4
PE1,1
PE1,2
PE1,3
PE1,4
VSI VS
VG VC
ON→OFF
OFF→ON

FIFTH EMBODIMENT

OPERATION OF FIFTH EMBODIMENT

OPERATION OF FIFTH EMBODIMENT
AT t2
AT t3
AT t4
SEG1
COM1
COM2
COM3
COM4
PE1,1
PE1,2
PE1,3
PE1,4
VG
VS
VCI
ON
OFF
ON→OFF
OFF→ON

MATRIX DISPLAY DEVICE, MATRIX DISPLAY DRIVING METHOD, AND MATRIX DISPLAY DRIVER CIRCUIT

BACKGROUND OF THE INVENTION

The present invention relates to a dot-matrix display device such as an organic electroluminescence (EL) display device, a method of driving the display device, and a driver circuit of the display device.

FIG. 29 is a circuit diagram showing a conventional organic EL display device. As shown in FIG. 29, the conventional display device has n common lines (namely, scan lines) $COM_1$ to $COM_n$ arranged in rows, m data lines $SEG_1$ to $SEG_m$ arranged in columns, and n×m EL elements $PE_{1,1}$ to $PE_{m,n}$ that are disposed at the intersections of the common lines and the data lines. In addition, the display device has switching elements $SW_{C1}$ to $SW_{Cn}$ which connect the common lines $COM_1$ to $COM_n$ to either the ground-voltage portion GND (voltage $V_G$) or the high-voltage portion 20 for common lines (common line power-supply voltage $V_C$), switching elements $SW_{S1}$ to $SW_{Sm}$ which connect the data lines $SEG_1$ to $SEG_m$ to either the ground-voltage portion GND (voltage $V_G$) or the high-voltage portion 30 for data lines (data-line power-supply voltage $V_S$), and a drive control circuit 10 which controls the switching elements $SW_{C1}$ to $SW_{Cn}$ and $SW_{S1}$ to $SW_{Sm}$. In FIG. 29, a reference 11 denotes a constant-current output circuit.

FIG. 30 is a waveform diagram showing the operation of the display device of FIG. 29. As shown in FIG. 30, the display device selects the common lines one after another, brings the selected common line to the ground voltage $V_G$, and brings the non-selected common lines to the common line power-supply voltage $V_C$ (reverse-bias voltage), during each display period $P_2$ included in each scan period $P_0$. During the display period $P_2$, selected data lines are brought to the data-line power-supply voltage $V_S$, and non-selected data lines are brought to the ground voltage $V_G$, on the basis of the signal input to the drive control circuit 10. During the display period $P_2$ time point $t_2$ to $t_3$) shown in FIG. 30, the data line $SEG_1$ is selected, so that the current $I_1$ flows through the EL element $PE_{1,1}$, thereby bringing the EL element $PE_{1,1}$ to the light-emitting state, as shown in FIG. 29.

In addition, as shown in FIG. 30, the display device brings all the common lines $COM_1$ to $COM_n$ and data lines $SEG_1$ to $SEG_m$ to the ground voltage $V_G$ during the discharge period $P_1$ included in the scan period $P_0$. During the discharge period $P_1$, the charge stored in the common lines $COM_1$ to $COM_n$ and data lines $SEG_1$ to $SEG_m$ are discharged.

When bringing the EL element $PE_{1,1}$ into the displaying state, for instance, the conventional display device as described above forms a current path passing the EL element $PE_{1,1}$ (the high-voltage portion 30 for data lines, the switching element $SW_{S1}$, the data line $SEG_1$, the selected EL element $PE_{1,1}$, the common line $COM_1$, the switching element $SW_{C1}$, and the ground-voltage portion GND in this order). In this type of display device, however, a current path passing a non-light-emitting EL element (for instance, the high-voltage portion 30 for data lines, the switching element $SW_{S1}$, the data line $SEG_1$, the non-selected EL elements $PE_{1,2}$ to $PE_{1,n}$, the non-selected common lines $COM_2$ to $COM_n$, the switching elements $SW_{C2}$ to $SW_{Cn}$, and the ground-voltage portion GND in this order), through which no current should flow, is instantaneously formed at a time point $t_1$ or $t_2$, for instance, and a shoot-through current (that is, "shoot-through current via non-selected EL elements") flows, resulting in a waste of power. Moreover, if the switching elements $SW_{C1}$ to $SW_{Cn}$ are configured as CMOS circuits, a current path passing a CMOS circuit (the high-voltage portion 20 for common lines, the PMOS transistor, the NMOS transistor, and the ground-voltage portion GND in this order) is instantaneously formed at a reversal of the CMOS circuit, causing a shoot-through current (that is, "shoot-through current of CMOS circuit") to flow, resulting in a waste of power.

SUMMARY OF THE INVENTION

It is an object of the present invention to provide such a display device that power consumption can be reduced by reducing the shoot-through current incident to turn-on or turn-off of a switching element, a method of driving the display device, and a driver circuit of the display device.

According to an aspect of the present invention, a display device comprises: n common lines arranged in rows, where n is a positive integer; m data lines arranged in columns, where m is a positive integer; n×m display elements positioned at intersections of the n common lines and the m data lines; a low-voltage portion for common lines; a high-voltage portion for common lines, which supplies a common line power-supply voltage that is higher than a voltage supplied by the low-voltage portion for common lines; a low-voltage portion for data lines; a high-voltage portion for data lines, which supplies a data-line power-supply voltage that is higher than a voltage supplied by the low-voltage portion for data lines; n first switching elements which are respectively connected to the n common lines and connect the common lines to the low-voltage portion for common lines during ON state of the n first switching elements; n second switching elements which are respectively connected to the n common lines and connect the common lines to the high-voltage portion for common lines during ON state of the n second switching elements; m third switching elements which are respectively connected to the m data lines and connect the data lines to the low-voltage portion for data lines during ON state of the m third switching elements; and m fourth switching elements which are respectively connected to the m data lines and connect the data lines to the high-voltage portion for data lines during ON state of the m fourth switching elements. The display element at an intersection of a selected one of the n common lines and a selected one of the m data lines is kept at a displaying state, the selected one of the n common lines being kept at a selected state, the selected one of the m data lines being kept at a selected state. The display device further comprises a drive control circuit which controls turn-on and turn-off of the n first switching elements, the n second switching elements, the m third switching elements, and the m fourth switching elements in each scan period including a display period in which the display elements are selectively brought to the displaying state and a discharge period in which electrical charge stored in the display elements is discharged. On the basis of control signals from the drive control circuit, the common line is brought to the selected state when the common line is connected to the low-voltage portion for common lines by turning on the first switching element and turning off the second switching element; the common line is brought to a non-selected state when the common line is brought to a high-impedance state by turning off both the first switching element and the second switching element; the data line is brought to the selected state when the data line is connected to the high-voltage portion for data lines by turning off the third switching element and turning on the fourth switching element; and the data line is brought to the non-selected state when the data line is connected to the low-voltage portion for data lines by turning on the third switching element and turning off the fourth switching element.

The display device eliminates the reversal of switching elements for common lines by bringing non-selected common lines to a high impedance (Hi-Z) state. Accordingly, the shoot-through current of the common line switching elements does not flow, which results in reduced power consumption.

Further, the display device may be controlled in such a way that in the discharge period, the n common lines are brought to the high-impedance state by turning off both the n first switching elements and the n second switching elements, and the m data lines are connected to the low-voltage portion for data lines by turning on the m third switching elements and by turning off the m fourth switching elements.

The display device brings the common lines to the Hi-Z state in the discharge period, so that the shoot-through current via non-selected display elements, which flows from the high-voltage portion for data lines through the data-line switching elements, non-selected display elements, and common line switching elements, can be eliminated, resulting in reduced power consumption.

Furthermore, the display device may be controlled in such a way that in the discharge period, the n common lines are connected to the high-voltage portion for common lines by turning off the n first switching elements and turning on the n second switching elements, and the m data lines are connected to the low-voltage portion for data lines by turning on the m third switching elements and turning off the m fourth switching elements.

The display device brings the common lines to the common line power-supply voltage in the discharge period, so that the shoot-through current through non-selected display elements, which flows from the high-voltage portion for data lines through data-line switching elements, non-selected display elements, and common line switching elements, can be eliminated, resulting in reduced power consumption.

Moreover, the display device may be controlled in such a way that in the discharge period, the n common lines are connected to the low-voltage portion for common lines by turning on the n first switching elements and by turning off the n second switching elements, and the m data lines are connected to the low-voltage portion for data lines by turning on the m third switching elements and turning off the m fourth switching elements.

In addition, the display device may be controlled in such a way that in the discharge period, the n common lines are connected to the low-voltage portion for common lines by turning on the n first switching elements and turning off the n second switching elements, the m data lines are connected to the low-voltage portion for data lines by turning on the m third switching elements and turning off the m fourth switching elements immediately before a start point of the discharge period, a state, in which the m data lines are connected to the low-voltage portion for data lines, is maintained until immediately after an end point of the discharge period, and the data line to be selected immediately after the end point of the discharge period is connected to the high-voltage portion for data lines by turning off the third switching element and turning on the fourth switching element of the data line to be selected.

The display device causes the reversal of switching elements for data lines to occur while the common lines are in the Hi-Z state, so that the shoot-through current through non-selected display elements does not flow, resulting in reduced power consumption.

Further, the display device may further comprise: a common line power-supply circuit which sets the high-voltage portion for common lines to the common line power-supply voltage; and a data-line power-supply circuit which sets the high-voltage portion for data lines to the data-line power-supply voltage, the low-voltage portion for common lines being connected to ground, the low-voltage portion for data lines being connected to ground.

Furthermore, the display device may further comprise: a common line power-supply circuit which sets the high-voltage portion for common lines to the common line power-supply voltage; a data-line power-supply circuit which sets the high-voltage portion for data lines to the data-line power-supply voltage; and an intermediate-voltage portion which sets the low-voltage portion for data lines to an intermediate voltage which is higher than the ground voltage and lower than the voltage of the high-voltage portion for data lines, the low-voltage portion for common lines being connected to ground.

In the display device, non-selected data lines are held to an intermediate voltage, so that the voltage difference from the data-line power-supply voltage of selected data lines decreases, resulting in reduced shoot-through current of switching elements for data lines. The display device can also reduce the difference between the voltage of selected or non-selected data line and the voltage in the discharge period, resulting in fast light-emitting response.

According to another aspect of the present invention, a display device comprises: n common lines arranged in rows, where n is a positive integer; m data lines arranged in columns, where m is a positive integer; n×m display elements positioned at intersections of the n common lines and the m data lines; a low-voltage portion for common lines; a high-voltage portion for common lines, which supplies a common line power-supply voltage that is higher than a voltage supplied by the low-voltage portion for common lines; a low-voltage portion for data lines; a high-voltage portion for data lines, which supplies a data-line power-supply voltage that is higher than a voltage supplied by the low-voltage portion for data lines; n first switching elements which are respectively connected to the n common lines and connect the common lines to the low-voltage portion for common lines during ON state; n second switching elements which are respectively connected to the n common lines and connect the common lines to the high-voltage portion for common lines during ON state of the n second switching elements; m third switching elements which are respectively connected to the m data lines and connect the data lines to the low-voltage portion for data lines during ON state of the m third switching elements; and m fourth switching elements which are respectively connected to the m data lines and connect the data lines to the high-voltage portion for data lines during ON state of the m fourth switching elements, The display element at an intersection of a selected one of the n common lines and a selected one of the m data lines is kept at displaying state, the selected one of the n common lines being kept at selected state, the selected one of the m data lines being kept at selected state. The display device further comprises: an intermediate-voltage portion which sets at least either the high-voltage portion for common lines or the low-voltage portion for data lines to an intermediate voltage which is higher than the ground voltage and lower than the common line power-supply voltage and data-line power-supply voltage; and a drive control circuit which controls the turn-on and turn-off of then first switching elements, then second switching elements, the m third switching elements, and the m fourth switching elements in each scan period including a display period in which display elements are selectively brought to the displaying state and a discharge period in which the charge stored in the display elements is discharged. On the basis of control signals from the drive control circuit, the common line is brought to the selected state when the common line is connected to the low-voltage portion for common lines by turning on the first switching element and turning off the second switching element; the common line is brought to non-selected state when the common line is connected to the high-voltage portion for common lines by turning off the first switching element and turning on the second switching element; the data line is brought to the selected state when the data line is connected to the high-voltage portion for data lines by turning off the third switching element and turning on the fourth switching element; and the data line is brought to the non-selected state when the data line is connected to the low-voltage portion for data lines by turning on the third switching element and by turning off the fourth switching element.

In the display device, non-selected data lines or non-selected common lines are held to an intermediate voltage, so that the shoot-through current of the switching elements can be reduced. The display device can also reduce the difference between the voltage of selected or non-selected data line and common line and the voltage in the discharge period, resulting in fast light-emitting response.

Further, the display device may be controlled in such a way that the high-voltage portion for common lines is set to an intermediate voltage which is higher than the ground voltage and lower than the common line power-supply voltage, and the low-voltage portion for data lines is set to an intermediate voltage which is higher than the ground voltage and lower than the data-line power-supply voltage.

Furthermore, the display device may be controlled in such a way that a pair of the first switching element and the second switching element connected to the same common line is configured by a CMOS circuit, and a pair of the third switching element and the fourth switching element connected to the same data line is configured by a CMOS circuit.

Moreover, the display device may be controlled in such a way that the common line power-supply voltage of the high-voltage portion for common lines is set to a voltage lower than the data-line power-supply voltage of the high-voltage portion for data lines.

The display device holds the common line power-supply voltage lower than the data-line power-supply voltage, so that the low common line power-supply voltage results in reduced power consumption.

According to yet another aspect of the present invention, a method is used for driving a display device, wherein the display device comprises: n common lines arranged in rows, where n is a positive integer; m data lines arranged in columns, where m is a positive integer; n×m display elements positioned at intersections of the n common lines and the m data lines; a low-voltage portion for common lines; a high-voltage portion for common lines, which supplies a common line power-supply voltage that is higher than a voltage supplied by the low-voltage portion for common lines; a low-voltage portion for data lines; a high-voltage portion for data lines, which supplies a data-line power-supply voltage that is higher than a voltage supplied by the low-voltage portion for data lines; n first switching elements which are respectively connected to the n common lines and connect the common lines to the low-voltage portion for common lines during ON state; n second switching elements which are respectively connected to the n common lines and connect the common lines to the high-voltage portion for common lines during ON state of the n second switching elements; m third switching elements which are respectively connected to the m data lines and connect the data lines to the low-voltage portion for data lines during ON state of the m third switching elements; and m fourth switching elements which are respectively connected to the m data lines and connect the data lines to the high-voltage portion for data lines during ON state of the m fourth switching elements; the display element at an intersection of a selected one of the n common lines and a selected one of the m data lines being kept at displaying state, the selected one of the n common lines being kept at selected state, the selected one of the m data lines being kept at selected state. The method comprises: controlling the turn-on and turn-off of the n first switching elements, the n second switching elements, the m third switching elements, and the m fourth switching elements in each scan period including a display period in which the display elements are selectively brought to the displaying state and a discharge period in which electrical charge stored in the display elements is discharged; turning on the first switching element and turning off the second switching element to connect the common line to the low-voltage portion for common lines when the common line is brought to the selected state; turning off both the first switching element and the second switching element to bring the common line to high-impedance state when the common line is brought to non-selected state; turning off the third switching element and turning on the fourth switching element to connect the data line to the high-voltage portion for data lines when the data line is brought to the selected state; and turning on the third switching element and turning off the fourth switching element to connect the data line to the low-voltage portion for data lines when the data line is brought to the non-selected state.

According to yet another aspect of the present invention, a method is used for driving a display device, wherein the display a device comprises: n common lines arranged in rows, where n is a positive integer; m data lines arranged in columns, where m is a positive integer; n×m display elements positioned at intersections of the n common lines and the m data lines; a low-voltage portion for common lines; a high-voltage portion for common lines, which supplies a common line power-supply voltage that is higher than a voltage supplied by the low-voltage portion for common lines; a low-voltage portion for data lines; a high-voltage portion for data lines, which supplies a data-line power-supply voltage that is higher than a voltage supplied by the low-voltage portion for data lines; n first switching elements which are respectively connected to the n common lines and connect the common lines to the low-voltage portion for common lines during ON state; n second switching elements which are respectively connected to the n common lines and connect the common lines to the high-voltage portion for common lines during ON state of the n second switching elements; m third switching elements which are respectively connected to the m data lines and connect the data lines to the low-voltage portion for data lines during ON state of the m third switching elements; and m fourth switching elements which are respectively connected to the m data lines and connect the data lines to the high-voltage portion for data lines during ON state of the m fourth switching elements; the display element at an intersection of a selected one of the n common lines and a selected one of the m data lines being kept at displaying state, the selected one of the n common lines being kept at selected state, the selected one of the m data lines being kept at selected state. The method comprises: controlling the turn-on and turn-off of the n first switching elements, the n second switching elements, the m third switching elements, and the m fourth switching elements in each scan period including a display period in which the display elements are selectively brought to the displaying state and a discharge period in which electrical charge stored in the display elements is discharged; setting at least either the high-voltage portion for common lines or the low-voltage portion for data lines to an intermediate voltage which is higher than the ground voltage and lower than the common line power-supply voltage and data-line power-supply voltage; turning on the first switching element and turning off the second switching element to connect the common line to the low-voltage portion for common lines when the common line is brought to the selected state; turning off the first switching element and turning on the second switching element to connect the common line to the high-voltage portion for common lines when the common line is brought to non-selected state; turning off the third switching element and turning on the fourth switching element to connect the data line to the high-voltage portion for data lines when the data line is brought to the selected state; and turning on the third switching element and by turning off the fourth switching element to connect the data line to the low-voltage portion for data lines when the data line is brought to the non-selected state.

According to yet another aspect of the present invention, a driver circuit is provided in a display device, wherein the display device comprises: n common lines arranged in rows, where n is a positive integer; m data lines arranged in columns, where m is a positive integer; n×m display elements positioned at intersections of the n common lines and the m data lines; a low-voltage portion for common lines; a high-voltage portion for common lines, which supplies a common line power-supply voltage that is higher than a voltage supplied by the low-voltage portion for common lines; a low-voltage portion for data lines; a high-voltage portion for data lines, which supplies a data-line power-supply voltage that is higher than a voltage supplied by the low-voltage portion for data lines; n first switching elements which are respectively connected to the n common lines and connect the common lines to the low-voltage portion for common lines during ON state; n second switching elements which are respectively connected to the n common lines and connect the common lines to the high-voltage portion for common lines during ON state of the n second switching elements; m third switching elements which are respectively connected to the m data lines and connect the data lines to the low-voltage portion for data lines during ON state of the m third switching elements; and m fourth switching elements which are respectively connected to the m data lines and connect the data lines to the high-voltage portion for data lines during ON state of the m fourth switching elements; the display element at an intersection of a selected one of the n common lines and a selected one of the m data lines being kept at displaying state, the selected one of the n common lines being kept at selected state, the selected one of the m data lines being kept at selected state. The driver circuit controls the turn-on and turn-off of the n first switching elements, the n second switching elements, the m third switching elements, and the m fourth switching elements in each scan period including a display period in which the display elements are selectively brought to the displaying state and a discharge period in which electrical charge stored in the display elements is discharged. On the basis of control signals from the driver circuit, the common line is brought to the selected state when the common line is connected to the low-voltage portion for common lines by turning on the first switching element and turning off the second switching element; the common line is brought to a non-selected state when the common line is brought to a high-impedance state by turning off both the first switching element and the second switching element; the data line is brought to the selected state when the data line is connected to the high-voltage portion for data lines by turning off the third switching element and turning on the fourth switching element; and the data line is brought to the non-selected state when the data line is connected to the low-voltage portion for data lines by turning on the third switching element and turning off the fourth switching element.

According to yet another aspect of the present invention, a driver circuit is provided in a display device, wherein the display device comprises: n common lines arranged in rows, where n is a positive integer; m data lines arranged in columns, where m is a positive integer; n×m display elements positioned at intersections of the n common lines and the m data lines; a low-voltage portion for common lines; a high-voltage portion for common lines, which supplies a common line power-supply voltage that is higher than a voltage supplied by the low-voltage portion for common lines; a low-voltage portion for data lines; a high-voltage portion for data lines, which supplies a data-line power-supply voltage that is higher than a voltage supplied by the low-voltage portion for data lines; n first switching elements which are respectively connected to the n common lines and connect the common lines to the low-voltage portion for common lines during ON state; n second switching elements which are respectively connected to the n common lines and connect the common lines to the high-voltage portion for common lines during ON state of the n second switching elements; m third switching elements which are respectively connected to the m data lines and connect the data lines to the low-voltage portion for data lines during ON state of the m third switching elements; and m fourth switching elements which are respectively connected to the m data lines and connect the data lines to the high-voltage portion for data lines during ON state of the m fourth switching elements; the display element at an intersection of a selected one of the n common lines and a selected one of the m data lines being kept at displaying state, the selected one of the n common lines being kept at selected state, the selected one of the m data lines being kept at selected state. The driver circuit controls the turn-on and turn-off of the n first switching elements, the n second switching elements, the m third switching elements, and the m fourth switching elements in each scan period including a display period in which the display elements are selectively brought to the displaying state and a discharge period in which electrical charge stored in the display elements is discharged. On the basis of control signals from the drive control circuit, the common line is brought to the selected state when the common line is connected to the low-voltage portion for common lines by turning on the first switching element and turning off the second switching element; the common line is brought to non-selected state when the common line is connected to the high-voltage portion for common lines by turning off the first switching element and turning on the second switching element; the data line is brought to the selected state when the data line is connected to the high-voltage portion for data lines by turning off the third switching element and turning on the fourth switching element; and the data line is brought to the non-selected state when the data line is connected to the low-voltage portion for data lines by turning on the third switching element and by turning off the fourth switching element.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2 is a waveform diagram showing the operation (1) of the first embodiment;

FIGS. 4A to 4C illustrate the operation of an example to be compared with;

FIG. 5 is a waveform diagram showing the operation (2) of the first embodiment;

FIG. 7 is a waveform diagram showing the operation (3) of the first embodiment;

FIG. 12 is a waveform diagram showing the operation (1) of the second embodiment;

FIG. 16 is a waveform diagram showing the operation (3) of the second embodiment;

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

<First Embodiment>

Figure 1:
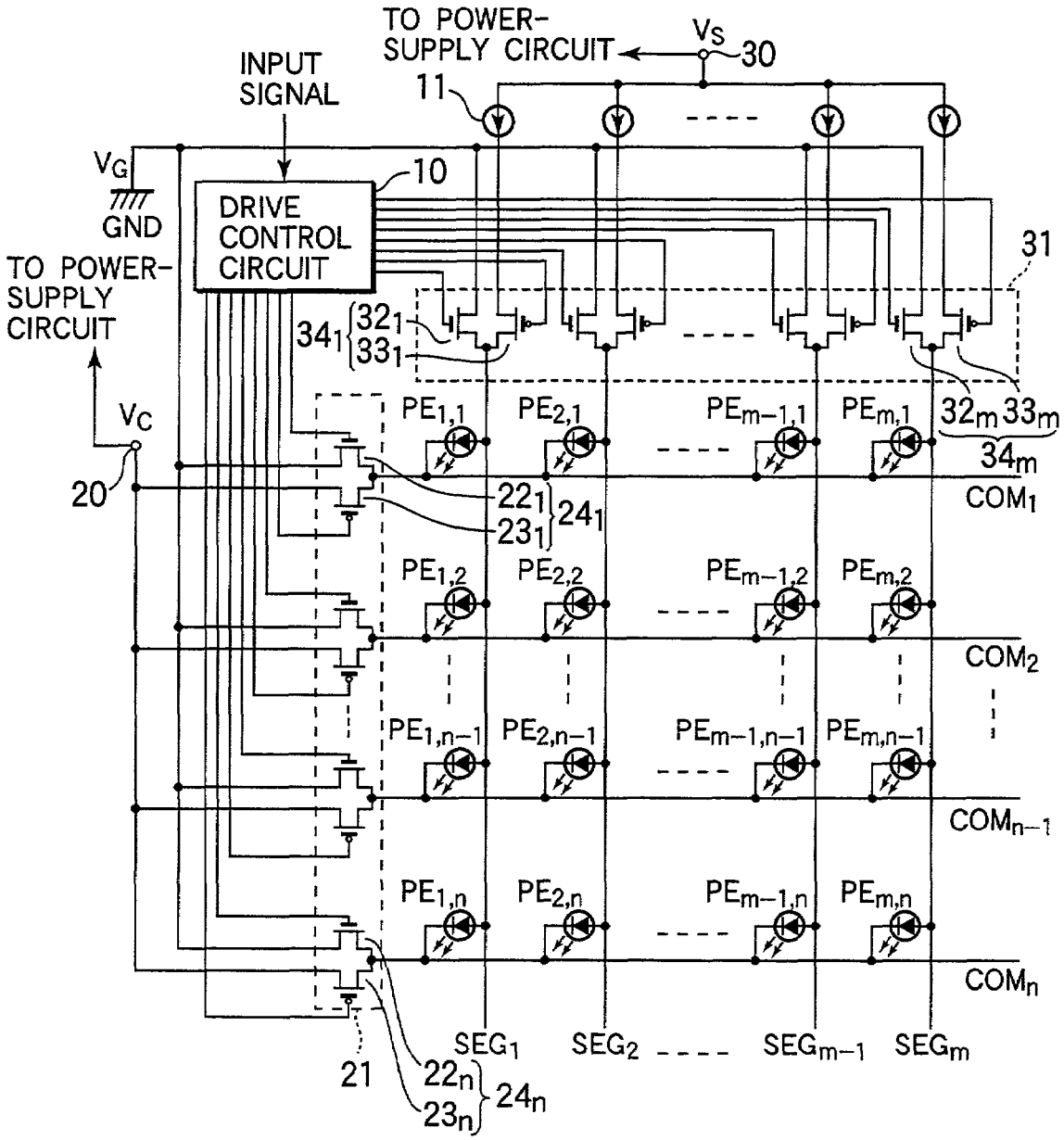
FIG. 1 is a circuit diagram showing an organic EL display device in accordance with a first embodiment of the present invention.

FIG. 1 is a circuit diagram showing an organic EL display device in accordance with a first embodiment of the present invention. The present invention, however, can be applied to current-driven dot-matrix display devices other than the organic EL display device (such as a liquid crystal display device).

As shown in FIG. 1, the display device of the first embodiment has n (n is a positive integer) common lines COM arranged in rows (individual common lines are denoted by references $COM_1$ to $COM_n$), m (m is a positive integer) data lines SEG arranged in columns (individual data lines are denoted by references $SEG_1$ to $SEG_m$), and n×m EL (electroluminescence) elements PE (individual EL elements are denoted by references $PE_{1,1}$ to $PE_{m,n}$) which are disposed at the intersections of the n common lines and the m data lines.

In addition, the display device of the first embodiment has a ground-voltage portion GND which supplies the ground voltage (i.e., ground potential) $V_G$, a high-voltage portion 20 for common lines which supplies the predetermined common line power-supply voltage $V_C$, which is higher than the ground voltage $V_G$, and a high-voltage portion 30 for data lines which supplies the predetermined data-line power-supply voltage $V_S$, which is higher than the ground voltage $V_G$. The high-voltage portion 20 for common lines is a terminal connected to a portion to output the common line power-supply voltage $V_C$ of a power supply circuit (not shown). The high-voltage portion 30 for data lines is a terminal connected to a portion to output the data-line power-supply voltage $V_S$ of the power supply circuit (not shown). The data-line power-supply voltage $V_S$ is at least a voltage needed to illuminate the EL elements $PE_{1,1}$ to $PE_{m,n}$ (more specifically, at least the sum of the minimum voltage (threshold voltage) needed to illuminate the EL elements and the voltage drop due to a current path other than the EL elements). Further, the voltages are generally set to be $V_S=V_C$, but $V_S>V_C$ is also possible in the first embodiment.

Moreover, the display device of the first embodiment has a common line switching circuit 21, a data-line switching circuit 31, a drive control circuit 10 which controls the operations of the common line switching circuit 21 and the data-line switching circuit 31, and a constant-current output circuit 11 which is disposed between the high-voltage portion 30 for data lines and the data-line switching circuit 31.

The common line switching circuit 21 has n NMOS transistors 22 (individual NMOS transistors are denoted by references $\mathbf{22}_1$ to $\mathbf{22}_n$) which are respectively connected to the n common lines $COM_1$ to $COM_n$ arranged in rows and connect the common lines $COM_1$ to $COM_n$ to the ground-voltage portion GND during ON state, and n PMOS transistors 23 (individual PMOS transistors are denoted by references $\mathbf{23}_1$ to $\mathbf{23}_n$) which are respectively connected to the n common lines $COM_1$ to $COM_n$ arranged in rows and connect the common lines $COM_1$ to $COM_n$ to the high-voltage portion 20 for common lines during ON state. A pair of NMOS transistor 22 and PMOS transistor 23 connected to the same common line COM is configured by a single CMOS circuit 24 (individual CMOS circuits are denoted by references $\mathbf{24}_1$ to $\mathbf{24}_n$). The common line switching circuit 21, however, may be comprised of either just PMOS transistors or just NMOS transistors, instead of the CMOS circuits 24.

In addition, the data-line switching circuit 31 has m NMOS transistors 32 (individual NMOS transistors are denoted by references $\mathbf{32}_1$ to $\mathbf{32}_m$) which are respectively connected to m data lines $SEG_1$ to $SEG_m$ arranged in columns and connect the data lines $SEG_1$ to $SEG_m$ to the ground-voltage portion GND during ON state, and m PMOS transistors 33 (individual PMOS transistors are denoted by references $\mathbf{33}_1$ to $\mathbf{33}_m$) which are respectively connected to m data lines $SEG_1$ to $SEG_m$ arranged in columns and connect the data lines $SEG_1$ to $SEG_m$ to the high-voltage portion 30 for data lines during ON state. A pair of NMOS transistor 32 and PMOS transistor 33 connected to the same data line SEG is configured by a single CMOS circuit 34 (individual CMOS circuits are denoted by references $\mathbf{34}_1$ to $\mathbf{34}_m$) The data-line switching circuit 31, however, may be comprised of either just PMOS transistors or just NMOS transistors, instead of the CMOS circuits 34.

The drive control circuit 10 controls the turn-on and turn-off of the n NMOS transistors $\mathbf{22}_1$ to $\mathbf{22}_n$, the n PMOS transistors $\mathbf{23}_1$ to $\mathbf{23}_n$, the m NMOS transistors $\mathbf{32}_1$ to $\mathbf{32}_m$, and the m PMOS transistors $\mathbf{33}_1$ to $\mathbf{33}_m$ on the basis of input signals, in each scan period (a time period $P_0$ in FIG. 2) including the display period (a time period $P_2$ in FIG. 2) in which the EL elements $PE_{1,1}$ to $PE_{m,n}$ are selectively brought to the displaying state (light-emitting state of the EL elements) and the discharge period (a time period $P_1$ in FIG. 2) in which the charge stored in the data lines SEG or the common lines COM is discharged. The EL element PE starts light-emitting when the voltage applied to the EL element PE becomes the same as or greater than the light-emitting threshold voltage after the constant-current supply through the constant-current output circuit 11 and the CMOS circuit for data lines.

(Operation (1) of the First Embodiment)

FIG. 2 is a waveform diagram showing the operation (1) of the first embodiment. As shown in FIG. 2, in the operation (1) of the first embodiment, the EL element PE at an intersection of a selected common line COM and a selected data line SEG is brought to the displaying state. The common line COM is selected when the common line COM is connected to the ground-voltage portion GND (voltage $V_G$) by turning on the NMOS transistor 22 and turning off the PMOS transistor 23. The common line COM is not selected when the common line COM is brought to high impedance (Hi-Z) state (diagonally shaded area in FIG. 2) by turning off both the NMOS transistor 22 and the PMOS transistor 23. In addition, as shown in FIG. 2, the data line SEG is selected when the data line SEG is connected to the high-voltage portion 30 for data lines (voltage $V_S$) by turning off the NMOS transistor 32 and turning on the PMOS transistor 33. The data line SEG is not selected when the data line SEG is connected to the ground-voltage portion GND (voltage $V_G$) by turning on the NMOS transistor 32 and turning off the PMOS transistor 33.

Moreover, as shown in FIG. 2, in the operation (1) of the first embodiment, the common lines $COM_1$ to $COM_n$ are selected and set to the ground voltage $V_G$ one after another in each display period $P_2$ included in the scan period $P_0$. In addition, as shown in FIG. 2, in the operation (1) of the first embodiment, all the common lines $COM_1$ to $COM_n$ are brought to the Hi-Z state and all the data lines $SEG_1$ to $SEG_m$ are set to the ground voltage $V_G$ in the discharge period $P_1$ included in the scan period $P_0$. In the discharge period $P_1$, the charge stored in the data line SEG is discharged.

Figures 3A, 3B, 3C:
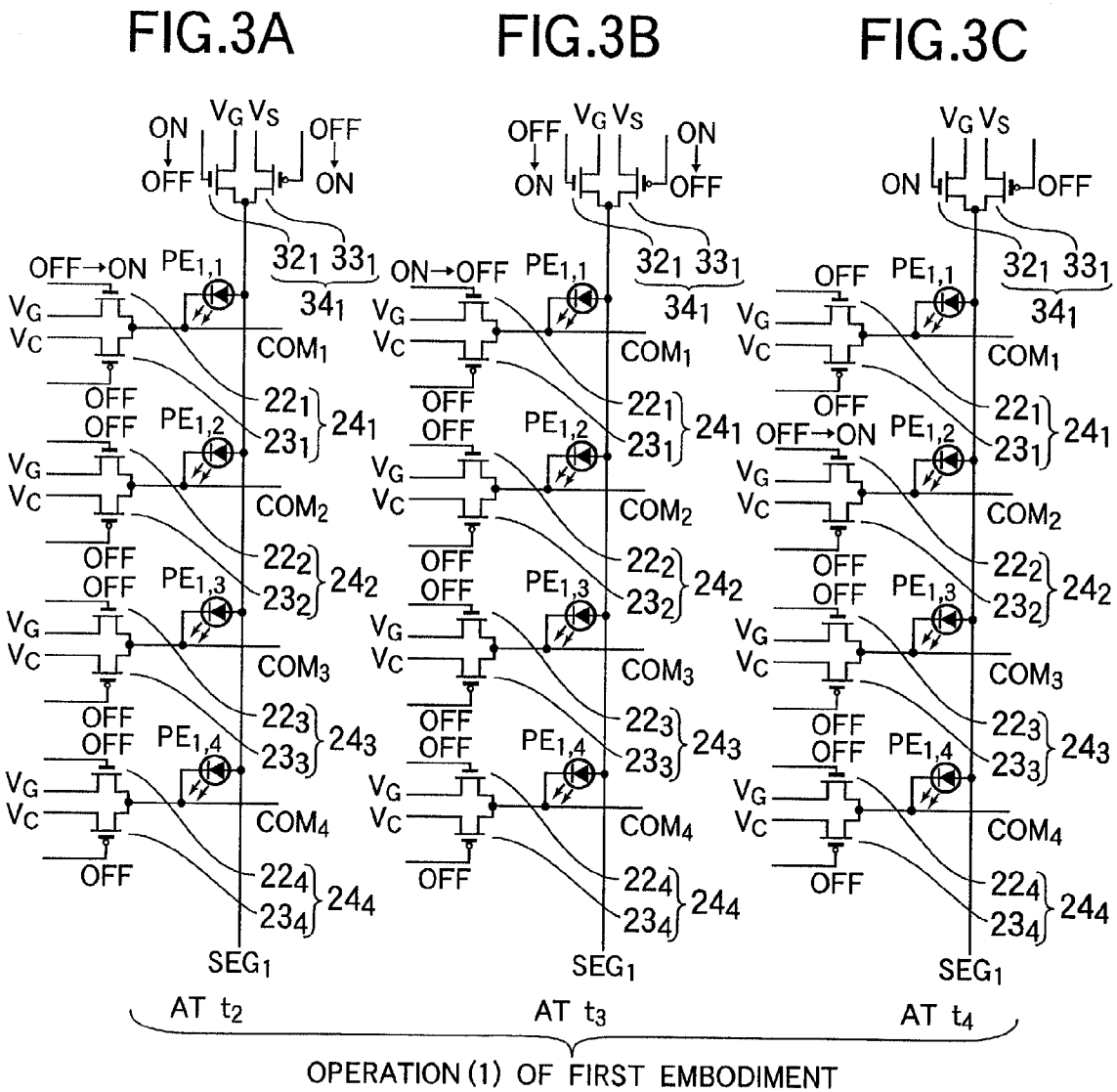
FIGS. 3A to 3C illustrate the operation (1) of the first embodiment.
Figure 30:
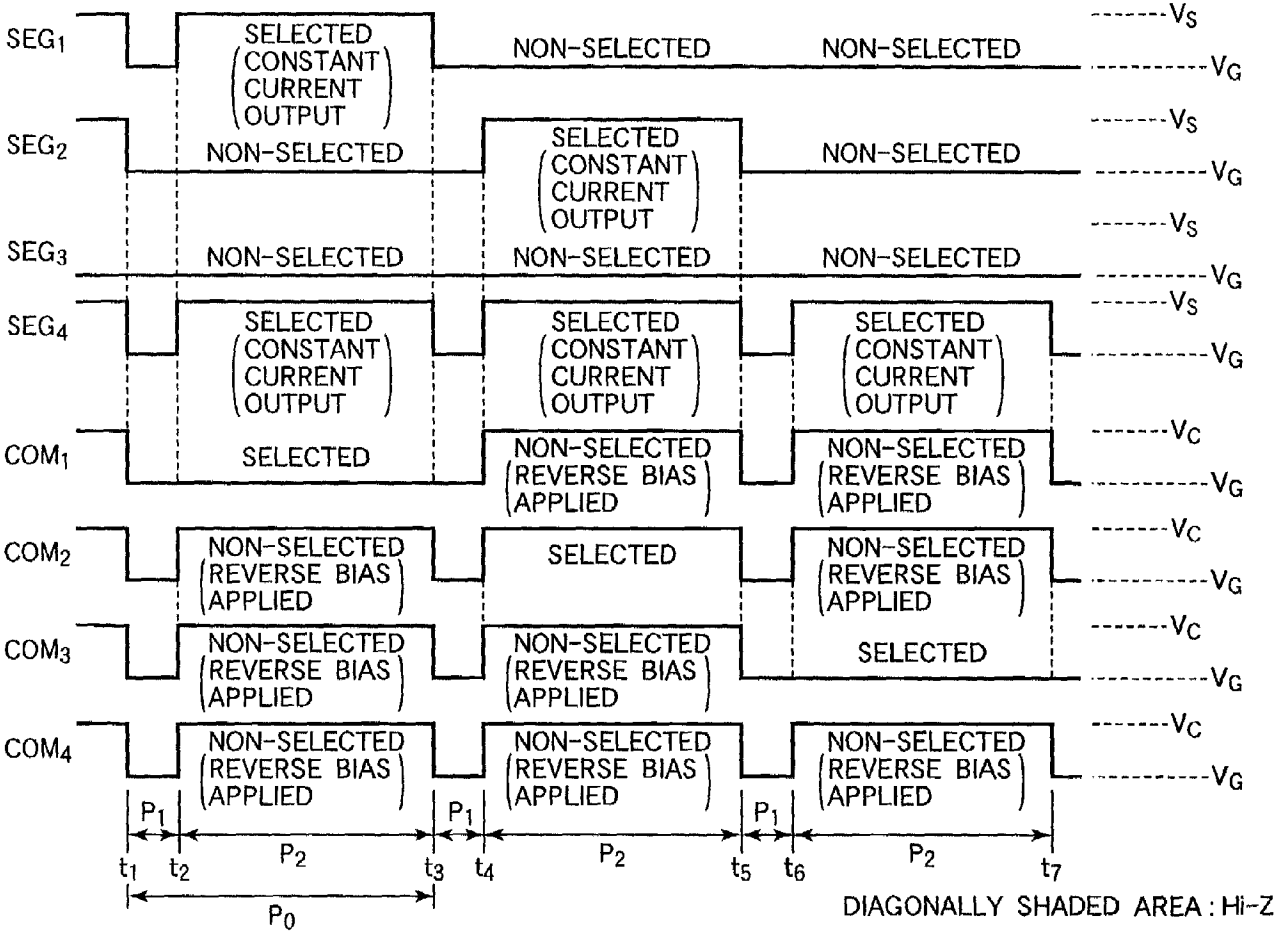
FIG.30 CONVENTIONAL ART
FIG. 30 is a waveform diagram showing the operation of the organic EL display device of FIG. 29.

FIGS. 3A to 3C illustrate the operation (1) of the first embodiment. In addition, FIGS. 4A to 4C illustrate the display device (an example to be compared with) which operates as illustrated in FIG. 30.

FIG. 3A shows the operation at a time point $t_2$ (being the start time of the display period $P_2$) in FIG. 2. At the time point $t_2$ in the common line switching circuit 21, the NMOS transistor $\mathbf{22}_1$ is switched from off to on, the PMOS transistor $\mathbf{23}_1$ is held off, the NMOS transistors $\mathbf{22}_2$, $\mathbf{22}_3$, and up are held off, and PMOS transistors $\mathbf{23}_2$, $\mathbf{23}_3$, and up are held off, as shown in FIG. 3A. Moreover, at the time point $t_2$ in the data-line switching circuit 31, the NMOS transistor $\mathbf{32}_1$ is switched from on to off, and the PMOS transistor $\mathbf{33}_1$ is switched from off to on, as shown in FIG. 3A.

As has been described above, in the operation (1) of the first embodiment, at the time point $t_2$ in the common line switching circuit 21, the NMOS transistor $\mathbf{22}_1$ is switched from off to on, the PMOS transistor $\mathbf{23}_1$ is held off, and the reversal of the CMOS circuit $\mathbf{24}_1$ for common line (switching the NMOS transistor $\mathbf{22}_1$ from off to on and switching the PMOS transistor $\mathbf{23}_1$ from on to off, and vice versa) does not occur. Accordingly, the "shoot-through current of the CMOS circuit $\mathbf{24}_1$ for common line" (a current corresponding to the shoot-through current $I_{11}$ in the example provided for comparison shown in FIG. 4C, for instance) does not flow at the time point $t_2$. Moreover, at the time point $t_2$, the NMOS transistors $\mathbf{22}_2$, $\mathbf{22}_3$, and up are held off, the PMOS transistors $\mathbf{23}_2$, $\mathbf{23}_3$, and up are held off, and the reversal of the CMOS circuits $\mathbf{24}_2$, $\mathbf{24}_3$, and up does not occur. Accordingly, the "shoot-through current of CMOS circuits $\mathbf{24}_2$, $\mathbf{24}_3$, and up for common lines" (a current corresponding to $I_{12}$, $I_{13}$, and up in the example provided for comparison shown in FIG. 4A, for instance) does not flow at the time point $t_2$.

Figures 4A, 4B, 4C:
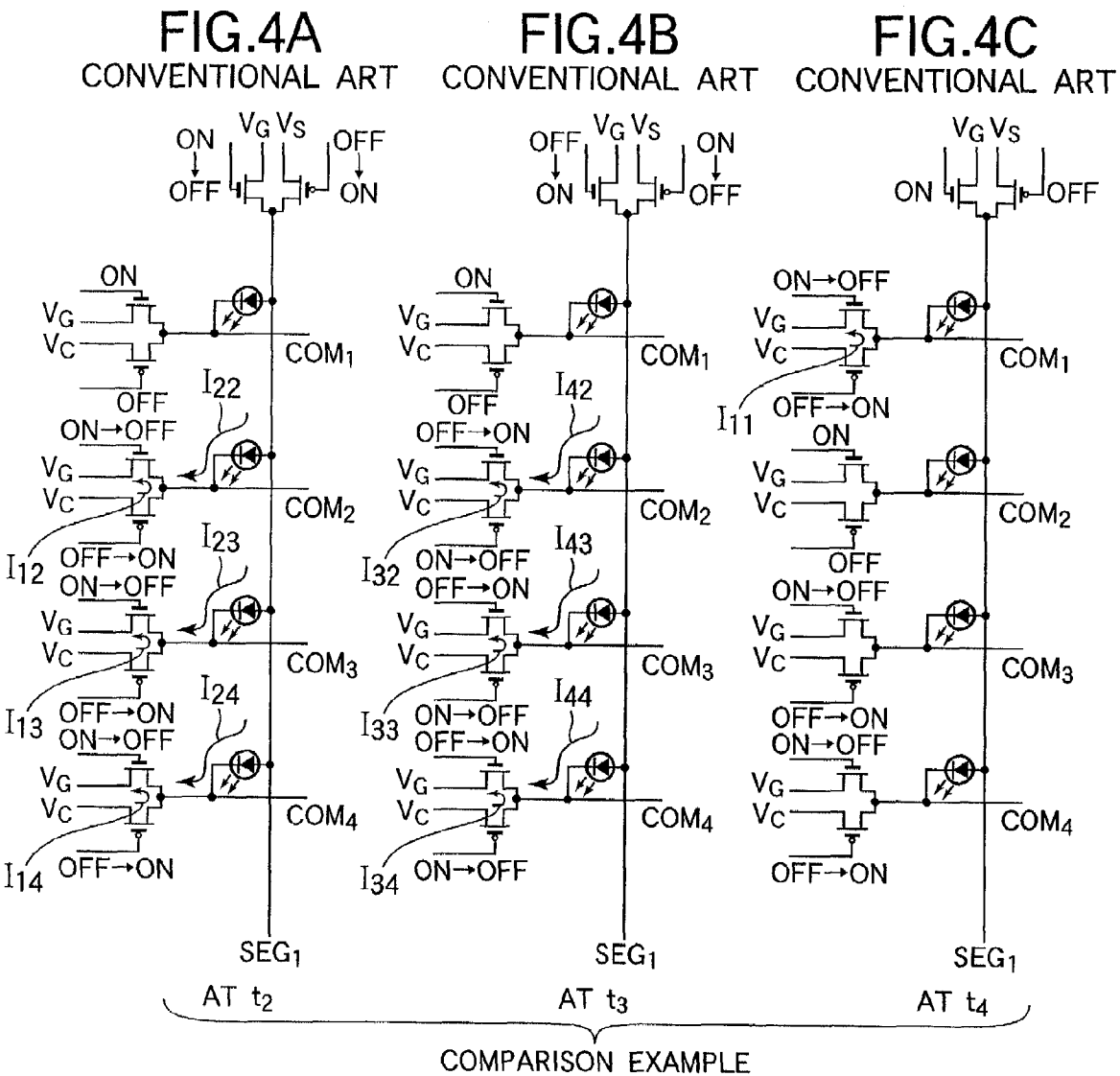
FIG.4A CONVENTIONAL ART
FIG.4B CONVENTIONAL ART
FIG.4C CONVENTIONAL ART

Furthermore, in the operation (1) of the first embodiment, at the time point $t_2$ in the data-line switching circuit 31, the NMOS transistor $\mathbf{32}_1$ is switched from off to on, and the PMOS transistor $\mathbf{33}_1$ is switched from on to off while the non-selected common lines $COM_2$ to $COM_n$ are held in the Hi-Z state, so that the "shoot-through current via non-selected EL elements" (current corresponding to $I_{22}$, $I_{23}$, and up in the example provided for comparison shown in FIG. 4A, for instance) does not flow.

FIG. 3B shows the operation at the time point $t_3$ (being the end point of the display period $P_2$ and also the start point of the discharge period $P_1$) in FIG. 2. As shown in FIG. 3B, at the time point $t_3$ in the common line switching circuit 21, the NMOS transistor $\mathbf{22}_1$ is switched from on to off, the PMOS transistor $23_1$ is held off, the NMOS transistors $22_2$, $22_3$, and up are held off, and the PMOS transistors $23_2$, $23_3$, and up are held off. In addition, as shown in FIG. 3B, at the time point $t_3$ in the data-line switching circuit 31, the NMOS transistor $32_1$ is switched from off to on, and the PMOS transistor $33_1$ is switched from on to off.

As has been described above, in the operation (1) of the first embodiment, at the time point $t_3$ in the common line switching circuit 21, the NMOS transistor $22_1$ is switched from on to off, the PMOS transistor $23_1$ is held off, and the reversal of the CMOS circuit $24_1$ does not occur. Accordingly, at the time point $t_3$ in the common line switching circuit 21, the "shoot-through current of the CMOS circuit $24_1$ for common line" does not flow. Moreover, at the time point $t_3$ in the common line switching circuit 21, the NMOS transistors $22_2$, $22_3$, and up are held off, the PMOS transistors $23_2$, $23_3$, and up are held off, and the reversal of the CMOS circuits $24_2$, $24_3$, and up for common lines does not occur. Accordingly, at the time point $t_3$, the "shoot-through current of the CMOS circuits $24_2$, $24_3$, and up for common lines" (current corresponding to $I_{32}$, $I_{33}$, and up in the comparison example shown in FIG. 4B, for instance) does not flow.

Furthermore, in the operation (1) of the first embodiment, at the time point $t_3$ in the data-line switching circuit 31, the NMOS transistor $32_1$ is switched from off to on, and the PMOS transistor $33_1$ is switched from on to off while the non-selected common lines $COM_2$ to $COM_n$ are held in the Hi-Z state, so that the "shoot-through current via non-selected EL element" (current corresponding to $I_{42}$, $I_{43}$, and up in the comparison example shown in FIG. 4B, for instance) does not flow.

FIG. 3C shows the operation at the time point $t_4$ (being the end point of the discharge period $P_1$ and also the start point of the next display period $P_2$) in FIG. 2. As shown in FIG. 3C, the operation at the time point $t_4$ is the same as the operation at the time point $t_2$, except that the next common line is selected. Accordingly, the reversal of the CMOS circuit 24 for common lines does not occur at the time point $t_4$ as in the case at the time point $t_2$, so that the "shoot-through current of the CMOS circuit 24 for common lines" does not flow.

In addition, the non-selected common lines $COM_1$ and $COM_3$ to $COM_n$ are held in the Hi-Z state at the time point $t_4$ as in the case at the time point $t_2$, so that the "shoot-through current via non-selected EL elements" does not flow.

As has been described above, in the operation (1) of the first embodiment, both the PMOS transistor and the NMOS transistor of the CMOS circuit 24 for common lines are switched off to bring the non-selected common lines to the Hi-Z state, so there is no reversal of the CMOS circuit 24 for common lines. Accordingly, the "shoot-through current of the CMOS circuit for common lines" as in the comparison example shown in FIGS. 4A to 4C is eliminated, thereby reducing the power consumption. In addition, because the CMOS circuit 24 for common lines is held in the Hi-Z state during the discharge period, the "shoot-through current via non-selected EL elements" that would flow from the high-voltage portion 30 for data lines through the CMOS circuit 34 for data lines, non-selected EL elements, and CMOS circuit 24 for common lines can be eliminated, thereby reducing the power consumption. Furthermore, in the operation (1) of the first embodiment, because the CMOS circuit 24 for non-selected common lines is held in the Hi-Z state, the common line power-supply voltage $V_C$ of the high-voltage portion 20 for common lines can be held lower than the data-line power-supply voltage $V_S$ of the high-voltage portion 30 for data lines, and this low common line power-supply voltage $V_C$ can result in reduced power consumption.

(Operation (2) of the First Embodiment)

FIG. 5 is a waveform diagram showing the operation (2) of the first embodiment. As shown in FIG. 5, in the operation (2) of the first embodiment, the common lines $COM_1$ to $COM_n$ are selected and set to the ground voltage $V_G$ one after another in each display period $P_2$ included in the scan period $P_0$. Moreover, as shown by the diagonally shaded areas in FIG. 5, the non-selected common lines are brought to the Hi-Z state in the display period $P_2$. Further, as shown in FIG. 5, in the operation (2) of the first embodiment, all the common lines $COM_1$ to $COM_n$ are set to the common line power-supply voltage $V_C$, and all the data lines $SEG_1$ to $SEG_m$ are set to the ground voltage $V_G$, in the discharge period $P_1$ included in the scan period $P_0$. In the operation (2) of the first embodiment, the charge stored in the data line SEG is discharged in the discharge period $P_1$.

Figures 6A, 6B, 6C:
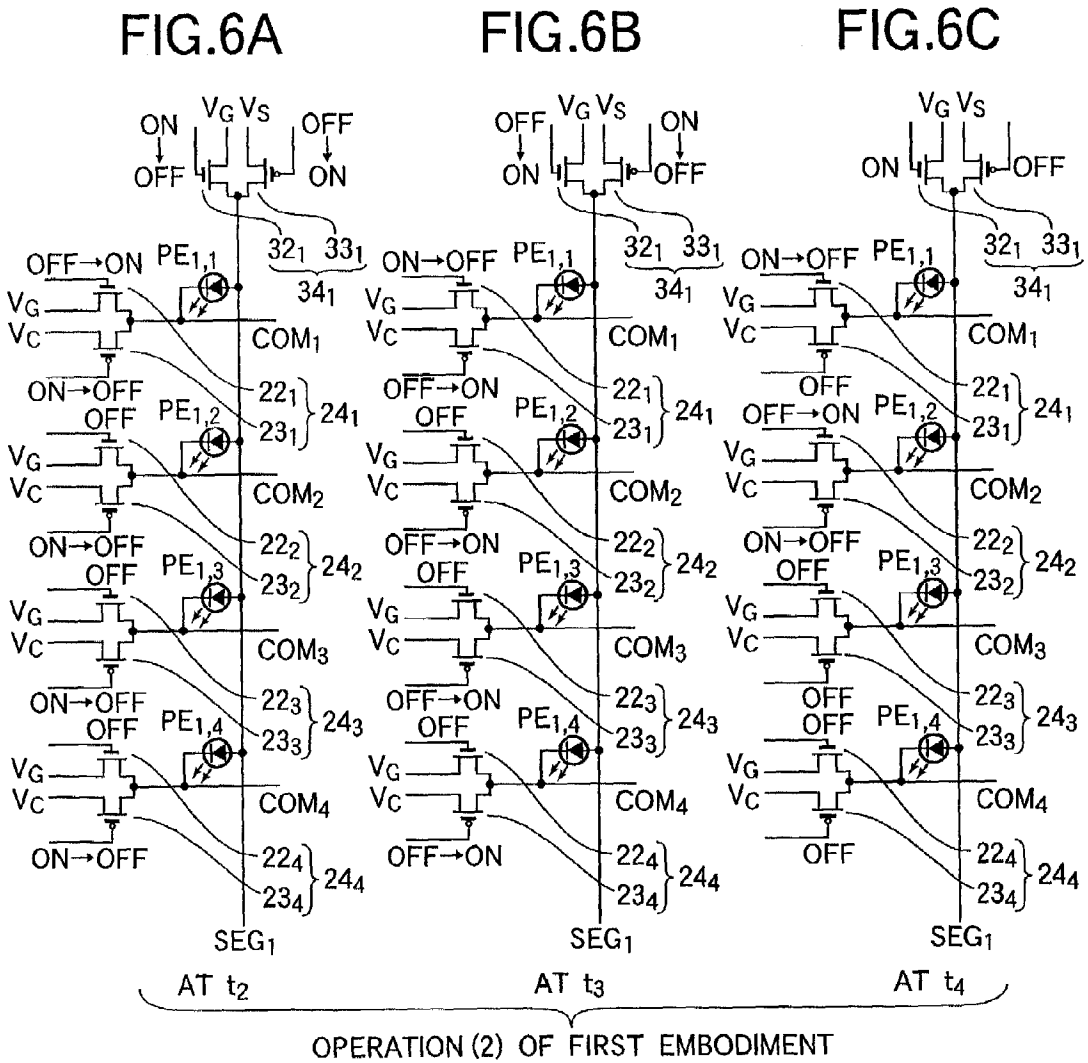
FIGS. 6A to 6C illustrate the operation (2) of the first embodiment.

FIGS. 6A to 6C illustrate the operation (2) of the first embodiment. FIG. 6A shows the operation at the time point $t_2$ (being the start point of the display period $P_2$) in FIG. 5. As shown in FIG. 6A, at the time point $t_2$ in the common line switching circuit 21, the NMOS transistor $22_1$ is switched from off to on, the PMOS transistor $23_1$ is switched from on to off, the NMOS transistors $22_2$, $22_3$, and up are held off, and the PMOS transistors $23_2$, $23_3$, and up are switched from on to off. In addition, as shown in FIG. 6A, at the time point $t_2$ in the data-line switching circuit 31, the NMOS transistor $32_1$ is switched from on to off, and the PMOS transistor $33_1$ is switched from off to on.

As has been described above, in the operation (2) of the first embodiment, at the time point $t_2$, the reversal of the CMOS circuit $24_1$ for common line occurs, but the reversal of the CMOS circuits $24_2$, $24_3$, and up for common lines does not occur. Accordingly, at the time point $t_2$, the "shoot-through current of CMOS circuit $24_1$ for common line" flows, but the "shoot-through current of other CMOS circuits $24_2$, $24_3$, and up for common lines" does not flow.

Moreover, in the operation (2) of the first embodiment, at the time point $t_2$, the NMOS transistor $32_1$ is switched from on to off, and the PMOS transistor $33_1$ is switched from off to on, but the non-selected common lines $COM_2$ to $COM_n$ are brought to the common line power-supply voltage $V_C$ or Hi-Z state, so that the "shoot-through current via non-selected EL elements" is small.

FIG. 6B shows the operation at the time point $t_3$ (being the end point of the display period $P_2$ and also the start point of the discharge period $P_1$) in FIG. 5. As shown in FIG. 6B, at the time point $t_3$ in the common line switching circuit 21, the NMOS transistor $22_1$ is switched from on to off, the PMOS transistor $23_1$ is switched from off to on, the NMOS transistors $22_2$, $22_3$, and up are held off, and the PMOS transistors $23_2$, $23_3$, and up are switched from off to on. In addition, as shown in FIG. 6B, at the time point $t_3$ in the data-line switching circuit 31, the NMOS transistor $32_1$ is switched from off to on, and the PMOS transistor $33_1$ is switched from on to off.

As has been described above, in the operation (2) of the first embodiment, at the time point $t_3$, the reversal of the CMOS circuit $24_1$ occurs, but the reversal of the CMOS circuits $24_2$, $24_3$, and up does not occur. Accordingly, the "shoot-through current of CMOS circuits $24_2$, $24_3$, and up" does not flow at the time point $t_3$.

Moreover, in the operation (2) of the first embodiment, at the time point $t_3$, the NMOS transistor $32_1$ is switched from off to on, and the PMOS transistor $33_1$ is switched from on to off, but the non-selected common lines $COM_2$ to $COM_n$ are held in the Hi-Z state, so that the "shoot-through current via non-selected EL elements" (current corresponding to $I_{52}$, $I_{53}$, and up in the comparison example shown in FIG. 4B, for instance) does not flow.

FIG. 6C shows the operation at the time point $t_4$ (being the end point of the discharge period $P_1$ and also the start point of the next display period $P_2$) in FIG. 5. As shown in FIG. 6C, the operation at the time point $t_4$ is the same as the operation at the time point $t_2$, except that the next common line is selected. Accordingly, at the time point $t_4$ as in the case at the time point $t_2$, the reversal of the CMOS circuit $24_2$ occurs, but the reversal of the CMOS circuits $24_1$ and $24_3$, $24_4$ and up does not occur. Accordingly, at the time point $t_2$, the "shoot-through current of the CMOS circuit $24_{12}$" flows, but the "shoot-through current of the other CMOS circuits $24_1$ and $24_3$, $24_4$, and up" does not flow.

In addition, at the time point $t_4$ as in the case at the time point $t_2$, the non-selected common lines $COM_1$ and $COM_3$ to $COM_n$ are held to the Hi-Z state or common line power-supply voltage $V_C$, so that the "shoot-through current via non-selected EL elements" is small.

As has been described above, in the operation (2) of the first embodiment, the number of reversals of the CMOS circuit for common lines is reduced by bringing the non-selected CMOS circuit for common lines to the Hi-Z state. Accordingly, the "shoot-through current of CMOS circuit for common line" decreases, resulting in reduced power consumption. In addition, because the CMOS circuit for common lines is set to the common line power-supply voltage $V_C$ in the discharge period, the "shoot-through current via non-selected EL elements" can be reduced, resulting in reduced power consumption.

(Operation (3) of the First Embodiment)

FIG. 7 is a waveform diagram showing the operation (3) of the first embodiment. As shown in FIG. 7, in the operation (3) of the first embodiment, the common lines $COM_1$ to $COM_n$ are selected and set to the ground voltage $V_G$ one after another in each display period $P_2$ included in the scan period $P_0$. Moreover, as shown by the diagonally shaded areas in FIG. 7, the non-selected common lines are brought to the Hi-Z state in the display period $P_2$. Further, as shown in FIG. 7, in the operation (3) of the first embodiment, all the common lines $COM_1$ to $COM_n$ are set to the ground voltage $V_G$, and all the data lines $SEG_1$ to $SEG_m$ are set to the ground voltage $V_G$, in the discharge period $P_1$ included in the scan period $P_0$. In the operation (3) of the first embodiment, the charge stored in the data line SEG and the charge stored in the common line COM are discharged in the discharge period $P_1$, preventing the failure of light-emitting.

Figures 8A, 8B, 8C:
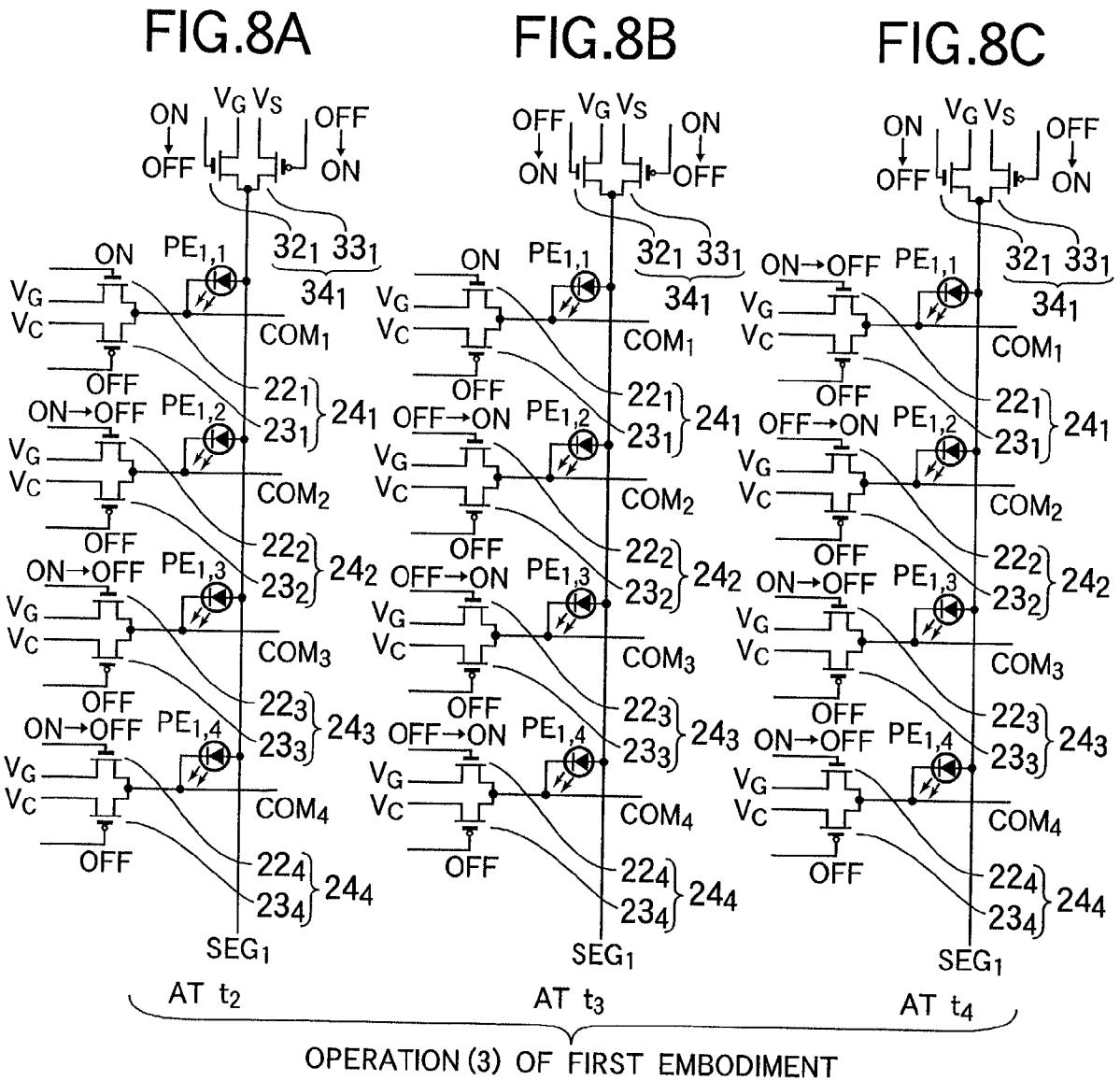
FIGS. 8A to 8C illustrate the operation (3) of the first embodiment.

FIGS. 8A to 8C illustrate the operation (3) of the first embodiment. FIG. 8A shows the operation at the time point $t_2$ (being the start point of the display period $P_2$) in FIG. 7. As shown in FIG. 8A, at the time point $t_2$ in the common line switching circuit 21, the NMOS transistor $22_1$ is held on, the PMOS transistor $23_1$ is held off, the NMOS transistors $22_2$, $22_3$, and up are switched from on to off, and the PMOS transistors $23_2$, $23_3$, and up are held off. In addition, as shown in FIG. 8A, at the time point $t_2$ in the data-line switching circuit 31, the NMOS transistor $32_1$ is switched from on to off, and the PMOS transistor $33_1$ is switched from off to on.

As has been described above, in the operation (3) of the first embodiment, the reversal of the CMOS circuit 24 for common lines does not occur. Accordingly, at the time point $t_2$, the "shoot-through current of CMOS circuit 24 for common lines" does not flow.

Moreover, in the operation (3) of the first embodiment, at the time point $t_2$, the NMOS transistor $32_1$ is switched from on to off, and the PMOS transistor $33_1$ is switched from off to on, but the non-selected common lines $COM_2$ to $COM_n$ are held to the ground voltage $V_G$ or the Hi-Z state, so that the "shoot-through current via non-selected EL elements" may flow.

FIG. 8B shows the operation at the time point $t_3$ (being the end point of the display period $P_2$ and also the start point of the discharge period $P_1$) in FIG. 7. As shown in FIG. 8B, at the time point $t_3$ in the common line switching circuit 21, the NMOS transistor $22_1$ is held on, the PMOS transistor $23_1$ is held off, the NMOS transistors $22_2$, $22_3$, and up are switched from off to on, and the PMOS transistors $23_2$, $23_3$, and up are held off. Moreover, as shown in FIG. 8B, at the time point $t_3$ in the data-line switching circuit 31, the NMOS transistor $32_1$ is switched from off to on, and the PMOS transistor $33_1$ is switched from on to off.

As has been described above, in the operation (3) of the first embodiment, the reversal of the CMOS circuit 24 does not occur at the time point $t_3$. Accordingly, the "shoot-through current of the CMOS circuit 24" does not flow at the time point $t_3$.

In addition, in the operation (3) of the first embodiment, at the time point $t_3$, the NMOS transistor $32_1$ is switched from off to on, and the PMOS transistor $33_1$ is switched from on to off, but the non-selected common lines $COM_2$ to $COM_n$ are held to the Hi-Z state or ground voltage $V_G$, so that the "shoot-through current via non-selected EL elements" may flow.

FIG. 8C shows the operation at the time point $t_4$ (being the end point of the discharge period $P_1$ and also the start point of the next display period $P_2$) in FIG. 7. As shown in FIG. 8C, the operation at the time point $t_4$ is the same as the operation at the time point $t_2$, except that the next common line is selected. Accordingly, the reversal of the CMOS circuit 24 for common lines does not occur at the time point $t_4$ as in the case at the time point $t_2$, so that the "shoot-through current of CMOS circuit 24 for common lines" does not flow.

As has been described above, in the operation (3) of the first embodiment, the reversal of the CMOS circuit for common lines is prevented by bringing the non-selected CMOS circuit for common lines to the Hi-Z state. Accordingly, the "shoot-through current of the CMOS circuit for common lines" decreases, resulting in reduced power consumption.

(Operation (4) of the First Embodiment)

Figure 9:
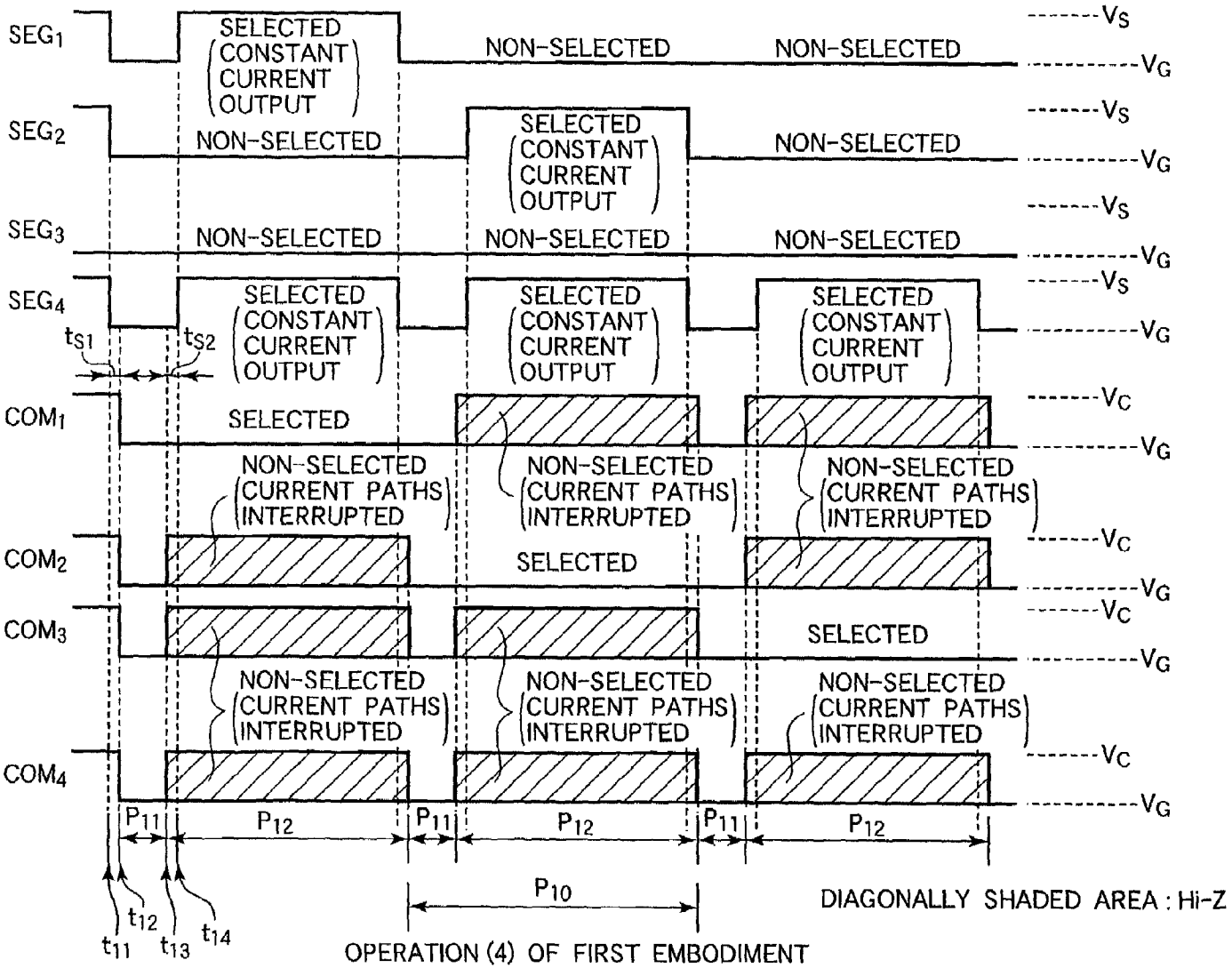
FIG. 9 is a waveform diagram showing the operation (4) of the first embodiment.

FIG. 9 is a waveform diagram showing the operation (4) of the first embodiment. As shown in FIG. 9, in the operation (4) of the first embodiment, the common lines $COM_1$ to $COM_n$ are selected and set to the ground voltage $V_G$ one after another in each display period $P_{12}$ included in the scan period $P_{10}$. In addition, as shown by the diagonally shaded areas in FIG. 9, the non-selected common lines are brought to the Hi-Z state in the display period $P_{12}$. Moreover, as shown in FIG. 9, in the operation (4) of the first embodiment, all the common lines $COM_1$ to $COM_n$ are set to the ground voltage $V_G$ in the discharge period $P_{11}$ included in the scan period $P_0$.

Further, in the operation (4) of the first embodiment, immediately before the start point $t_{12}$ of the discharge period $P_{11}$ (at the time point $t_{11}$), the NMOS transistor 32 is switched from off to on, the PMOS transistor 33 is switched from on to off, and the data line is connected to the ground voltage $V_G$; and these states are maintained until immediately after the end point $t_{13}$ of the discharge period (at the time point $t_{14}$); and the data line to be selected is connected to the high-voltage portion 30 for data lines by turning off the NMOS transistor 32 and turning on the PMOS transistor 33, of the data line to be selected immediately after the discharge period (at the time point $t_{14}$). In other words, the reversal of the CMOS circuit 34 for data lines occurs at the time point ($t_{11}$) which is a specified time period $t_{s1}$ earlier than the start point $t_{12}$ of the discharge period $P_{11}$ and at the time point ($t_{12}$) which is a specified time period $t_{s2}$ later than the end point $t_{13}$ of the discharge period $P_{11}$, which are the time period when the non-selected common lines are held to the Hi-Z state.

Figures 10A, 10B, 10C, 10D:
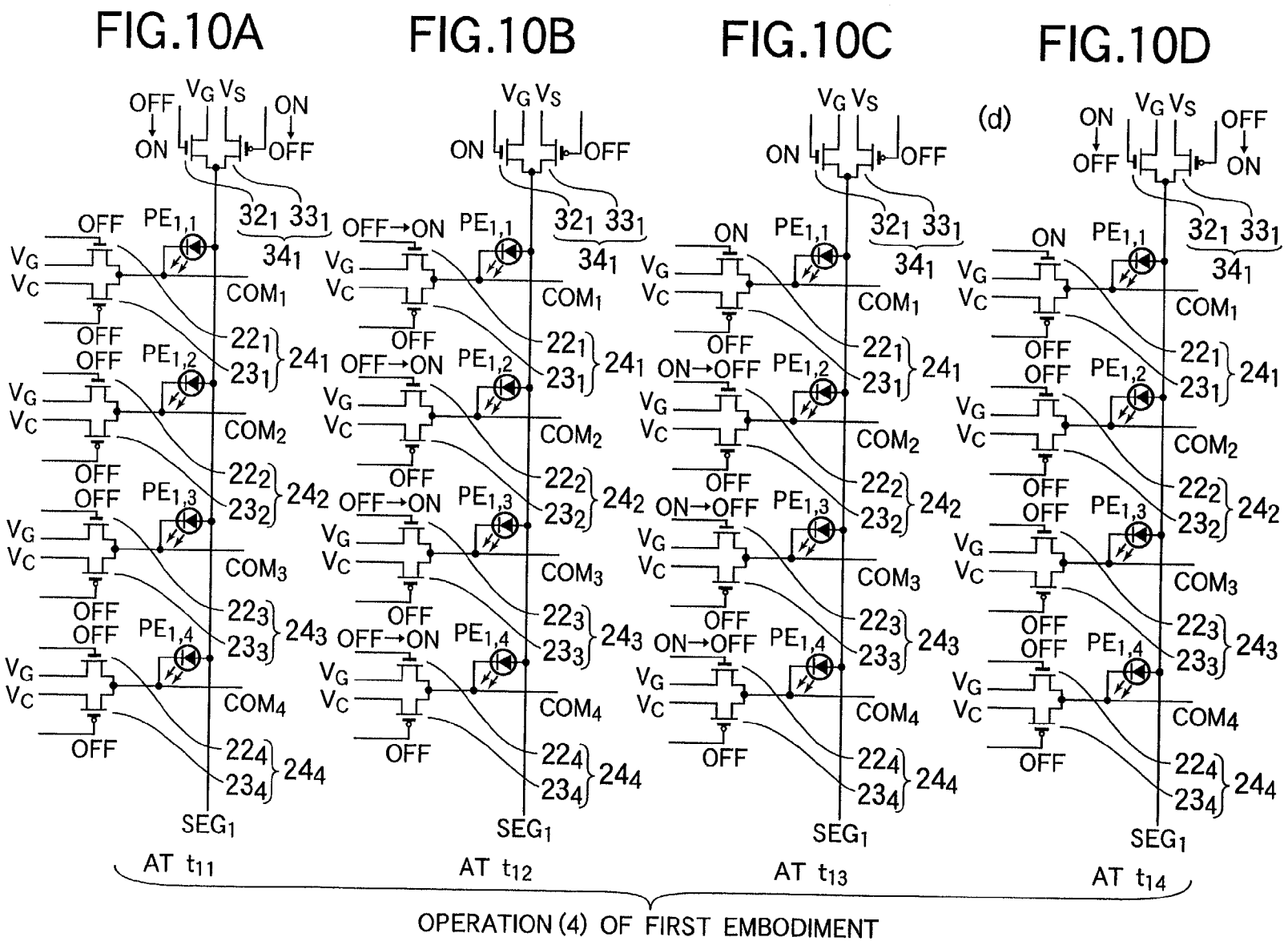
FIGS. 10A to 10D illustrate the operation (4) of the first embodiment.

FIGS. 10A to 10D illustrate the operation (4) of the first embodiment. FIG. 10A shows the operation at the time point $t_{11}$ in FIG. 7. As shown in FIG. 10A, at the time point $t_{11}$ in the common line switching circuit 21, the NMOS transistor $\mathbf{22}_1$ is held off, the PMOS transistor $\mathbf{23}_1$ is held off, the NMOS transistors $\mathbf{22}_2$, $\mathbf{22}_3$, and up are held off, and the PMOS transistors $\mathbf{23}_2$, $\mathbf{23}_3$, and up are held off. This means that all the common lines are held in the Hi-Z state. In addition, as shown in FIG. 10A, at the time point $t_{11}$ in the data-line switching circuit 31, the NMOS transistor $\mathbf{32}_1$ is switched from off to on, and the PMOS transistor $\mathbf{33}_1$ is switched from on to off. This means that the reversal of the CMOS circuit $\mathbf{34}_1$ occurs.

As has been described above, in the operation (4) of the first embodiment, at the time point $t_{11}$, the NMOS transistor $\mathbf{32}_1$ is switched from on to off, and the PMOS transistor $\mathbf{33}_1$ is switched from off to on, but the common lines $COM_2$ to $COM_n$ are held in the Hi-Z state, so that the "shoot-through current via non-selected EL elements" does not flow.

FIG. 10B shows the operation at the time point $t_{12}$ in FIG. 9. As shown in FIG. 10B, at the time point $t_{12}$ in the common line switching circuit 21, the NMOS transistor 22 is switched from off to on, and the PMOS transistor 23 is held off. Moreover, as shown in FIG. 10B, at the time point $t_{12}$ in the data-line switching circuit 31, the NMOS transistor $\mathbf{32}_1$ is held on, and the PMOS transistor $\mathbf{33}_1$ is held off.

As has been described above, in the operation (4) of the first embodiment, the reversal of the CMOS circuit 24 does not occur. Accordingly, the "shoot-through current of the CMOS circuit 24" for common lines does not flow at the time point $t_{12}$.

FIG. 10C shows the operation at the time point $t_{13}$ in FIG. 9. As shown in FIG. 10C, at the time point $t_{13}$ in the common line switching circuit 21, the NMOS transistor $\mathbf{22}_1$ is held on, the PMOS transistor $\mathbf{23}_1$ is held off, the NMOS transistors $\mathbf{22}_2$, $\mathbf{22}_3$, and up are switched from on to off, and the PMOS transistors $\mathbf{23}_2$, $\mathbf{23}_3$, and up are held off. Moreover, as shown in FIG. 10C, at the time point $t_{13}$ in the data-line switching circuit 31, the NMOS transistor $\mathbf{32}_1$ is held on, and the PMOS transistor $\mathbf{33}_1$ is held off.

As has been described above, in the operation (3) of the first embodiment, the reversal of the CMOS circuit 24 for common lines does not occur at the time point $t_{13}$. Accordingly, the "shoot-through current of CMOS circuit 24 for common lines" does not flow at the time point $t_{13}$.

FIG. 10D shows the operation at the time point $t_{14}$ in FIG. 9. As shown in FIG. 10D, at the time point $t_{14}$ in the common line switching circuit 21, the NMOS transistor $\mathbf{22}_1$ is held on, the PMOS transistor $\mathbf{23}_1$ is held off, the NMOS transistors $\mathbf{22}_2$, $\mathbf{22}_3$, and up are held off, and the PMOS transistors $\mathbf{23}_2$, $\mathbf{23}_3$, and up are held off. In addition, as shown in FIG. 10D, at the time point $t_{14}$ in the data-line switching circuit 31, the NMOS transistor $\mathbf{32}_1$ is switched from on to off, and the PMOS transistor $\mathbf{33}_1$ is switched from off to on.

As has been described above, in the operation (4) of the first embodiment, at the time point $t_{14}$, the NMOS transistor $\mathbf{32}_1$ is switched from on to off, and the PMOS transistor $\mathbf{33}_1$ is switched from off to on, but the common lines $COM_2$ to $COM_n$ are held in the Hi-Z state, so that the "shoot-through current via non-selected EL elements" does not flow.

As has been described above, in the operation (4) of the first embodiment, the reversal of the CMOS circuit for data lines occurs while the common line COM is in the Hi-Z state, so that the "shoot-through current via non-selected EL elements" does not flow, resulting in reduced power consumption.

The operation (4) of the first embodiment corresponds to an example in which the reversal timing of the CMOS circuit for data lines in the operation (3) of the first embodiment described above is shifted by the time periods $t_{s1}$ and $t_{s2}$, and the reversal timing of the CMOS circuit for data lines of this type may be applied to the operations (1) and (2) of the first embodiment described above.

<Second Embodiment>

Figure 11:
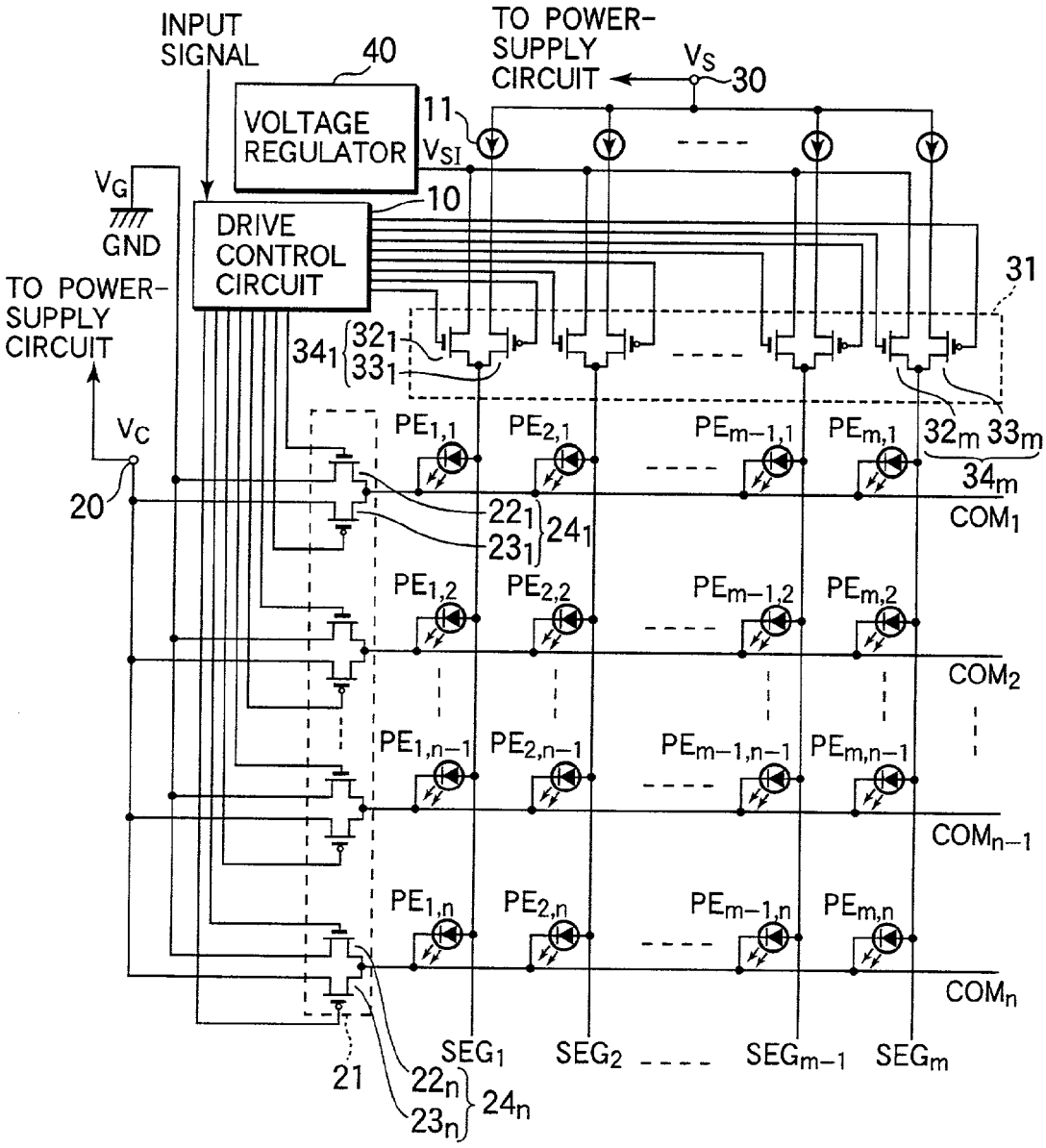
FIG. 11 is a circuit diagram showing an organic EL display device in accordance with a second embodiment of the present invention.

FIG. 11 is a circuit diagram showing an organic EL display device in accordance with a second embodiment of the present invention. In FIG. 11, the components that are the same as or equivalent to those in FIG. 1 are denoted by the same references. The second embodiment is different from the first embodiment described above in these points: a voltage regulator 40 for supplying an intermediate voltage $V_{SI}$, which is higher than the ground voltage $V_G$ and lower than the data-line power-supply voltage $V_S$ of the high-voltage portion 30 for data lines, is provided; and the NMOS transistor 32 of the data-line switching circuit 31 is not connected to the ground GND but connected to the portion to output the intermediate voltage $V_{SI}$ of the voltage regulator 40. The voltage regulator 40 may be replaced by some other means such as an external power supply.

(Operation (1) of the Second Embodiment)

Figures 13A, 13B, 13C:
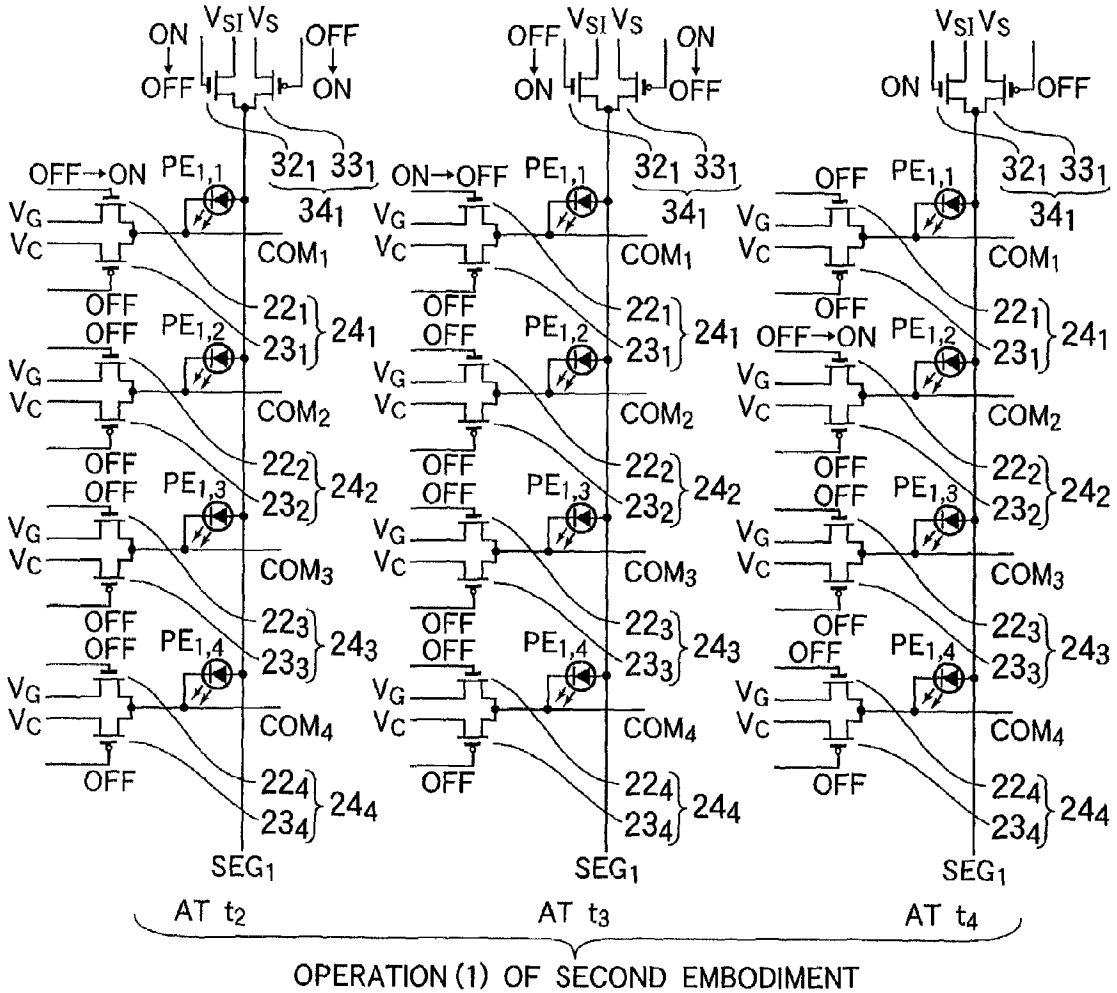
FIGS. 13A to 13C illustrate the operation (1) of the second embodiment.

FIG. 12 is a waveform diagram showing the operation (1) of the second embodiment, and FIGS. 13A to 13C illustrate the operation (1) of the second embodiment. The operation (1) of the second embodiment shown in FIG. 12 and FIGS. 13A to 13C is different from the operation (1) of the first embodiment shown earlier in FIG. 2 and FIGS. 3A to 3C in these points: the NMOS transistor 32 of the data-line switching circuit 31 is connected to the portion to output the intermediate voltage $V_{SI}$ of the voltage regulator 40; and the voltage of the non-selected data line SEG is set to the intermediate voltage $V_{SI}$.

In the operation (1) of the second embodiment, because the non-selected data lines are set to the intermediate voltage $V_{SI}$, the difference in voltage from the voltage $V_S$ of the selected data line is smaller than when the non-selected data lines are set to the ground voltage $V_G$, thereby reducing the "shoot-through current of the CMOS circuit 34 for data lines" which is incident to the reversal of the CMOS circuit 34 for data lines. In addition, the difference between the voltage $V_S$ at the selection of a data line and the voltage (intermediate voltage $V_{SI}$) of the data line in the discharge period is reduced, resulting in a faster light-emitting response. The operation (1) of the second embodiment is the same as the operation (1) of the first embodiment described earlier, except for the points described above.

(Operation (2) of the Second Embodiment)

Figure 14:
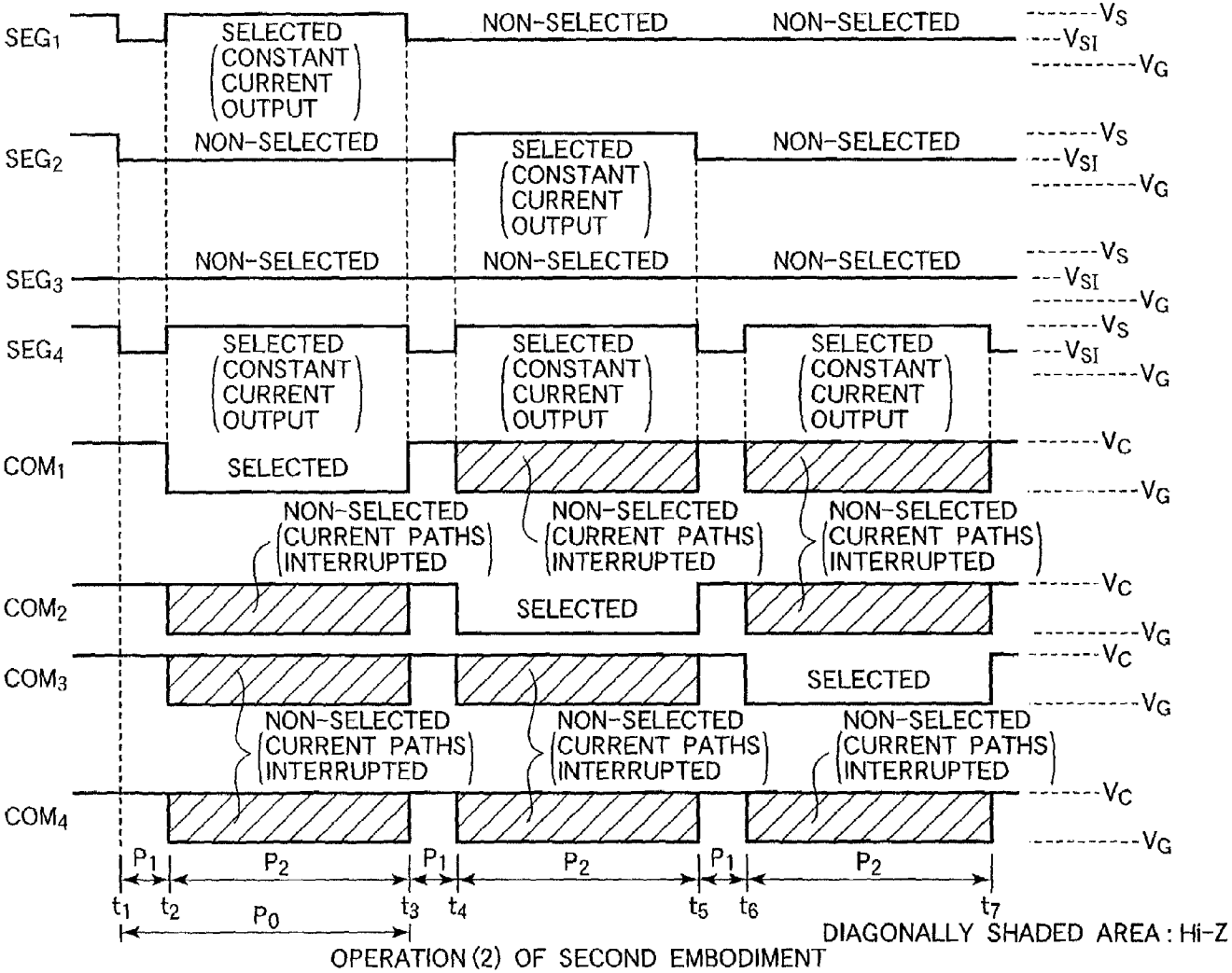
FIG. 14 is a waveform diagram showing the operation (2) of the second embodiment.
Figures 15A, 15B, 15C:
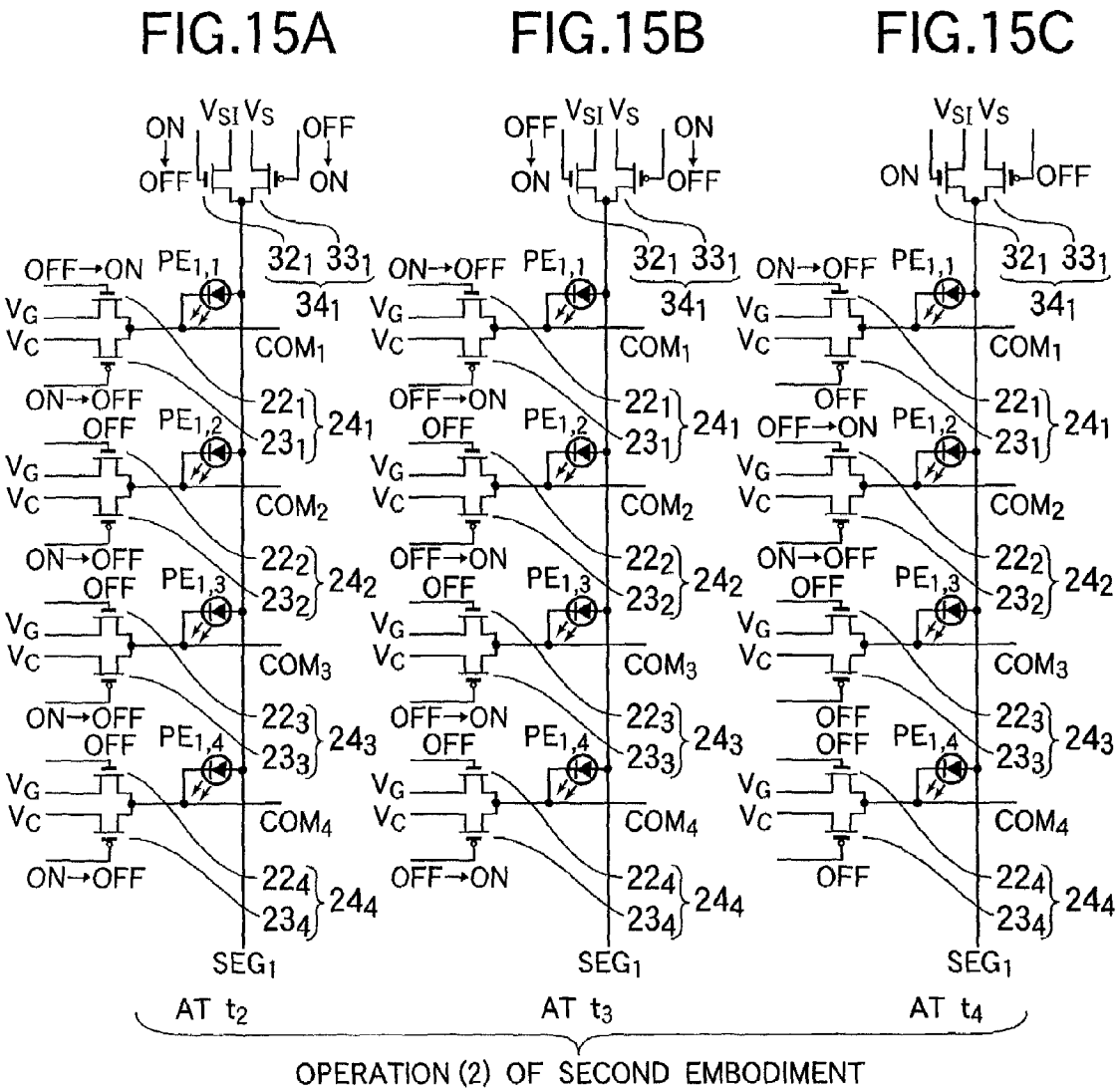
FIGS. 15A to 15C illustrate the operation (2) of the second embodiment.

FIG. 14 is a waveform diagram showing the operation (2) of the second embodiment, and FIGS. 15A to 15C illustrate the operation (2) of the second embodiment. The operation (2) of the second embodiment shown in FIG. 14 and FIGS. 15A to 15C is different from the operation (2) of the first embodiment shown earlier in FIG. 5 and FIGS. 6A to 6C in that the voltage of the non-selected data line SEG is set to the intermediate voltage $V_{SI}$ by connecting the NMOS transistor 32 of the data-line switching circuit 31 to the portion to output the intermediate voltage $V_{SI}$ of the voltage regulator 40.

Because the non-selected data lines are set to the intermediate voltage $V_{SI}$ in the operation (2) of the second embodiment, the difference in voltage from the voltage $V_S$ of a selected data line becomes smaller than when the non-selected data lines are set to the ground voltage $V_G$, thereby reducing the "shoot-through current of the CMOS circuit 34 for data lines" which is incident to a reversal of the CMOS circuit 34 for data lines. In addition, the difference between the voltage $V_S$ at the selection of a data line and the voltage (intermediate voltage $V_{SI}$) of the data line in the discharge period is reduced, resulting in a faster light-emitting response. The operation (2) of the second embodiment is the same as the operation (2) of the first embodiment described earlier, except for the points described above.

(Operation (3) of the Second Embodiment)

Figures 17A, 17B, 17C:
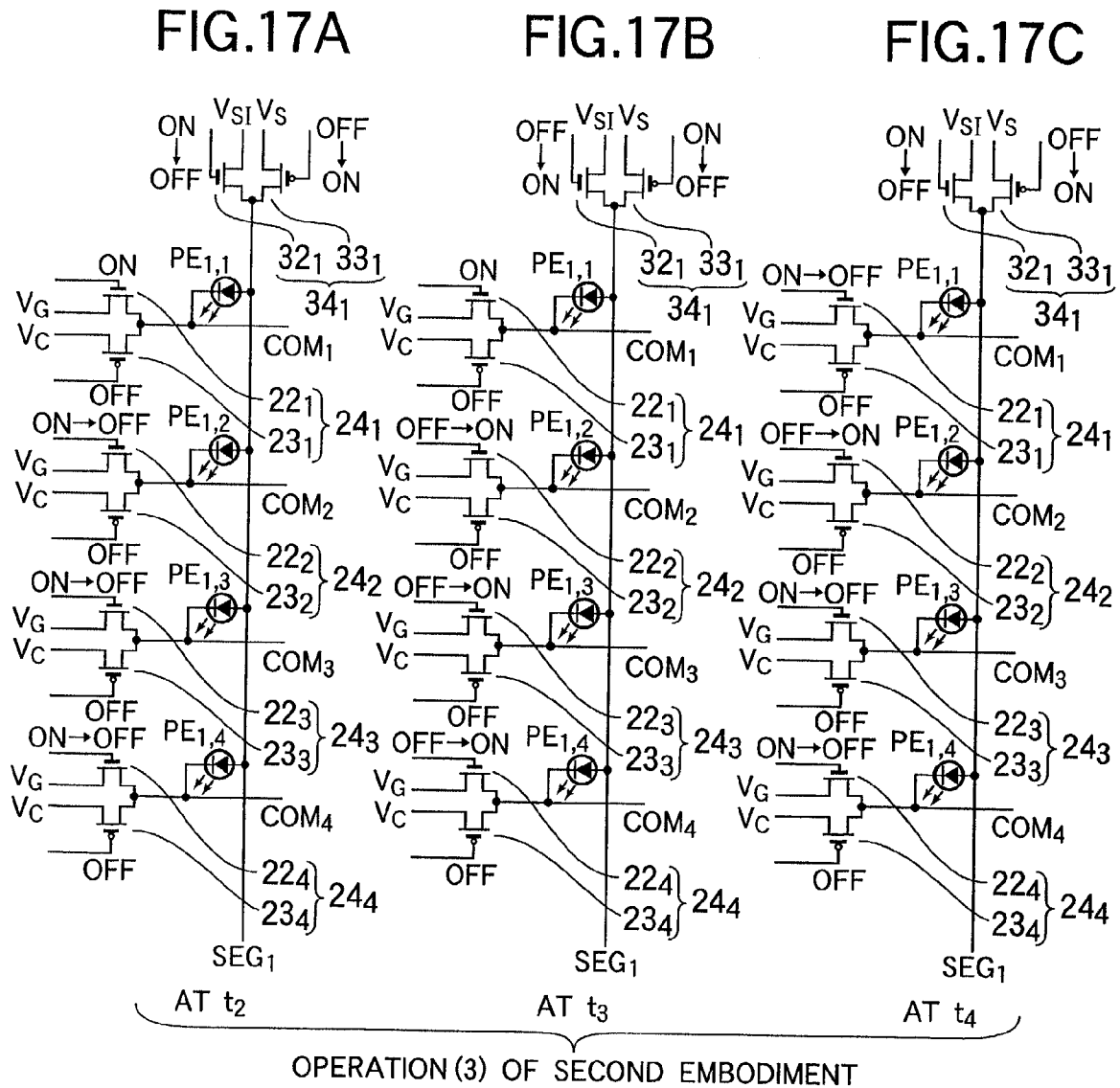
FIGS. 17A to 17C illustrate the operation (3) of the second embodiment.

FIG. 16 is a waveform diagram showing the operation (3) of the second embodiment, and FIGS. 17A to 17C illustrate the operation (3) of the second embodiment. The operation (3) of the second embodiment shown in FIG. 16 and FIGS. 17A to 17C is different from the operation (3) of the first embodiment shown earlier in FIG. 7 and FIGS. 8A to 8C in that the voltage of the non-selected data line SEG is set to the intermediate voltage $V_{SI}$ by connecting the NMOS transistor 32 of the data-line switching circuit 31 to the portion to output the intermediate voltage $V_{SI}$ of the voltage regulator 40.

Because the non-selected data lines are set to the intermediate voltage $V_{SI}$ in the operation (3) of the second embodiment, the difference in voltage from the voltage $V_S$ of the selected data line is smaller than when the non-selected data lines are set to the ground voltage $V_G$, thereby reducing the "shoot-through current of the CMOS circuit 34 for data lines" which is incident to a reversal of the CMOS circuit 34 for data lines. In addition, the difference between the voltage $V_S$ at the selection of a data line and the voltage (intermediate voltage $V_{SI}$) of the data line in the discharge period is reduced, resulting in a faster light-emitting response. The operation (3) of the second embodiment is the same as the operation (3) of the first embodiment described earlier, except for the points described above.

(Operation (4) of the Second Embodiment)

Figure 18:
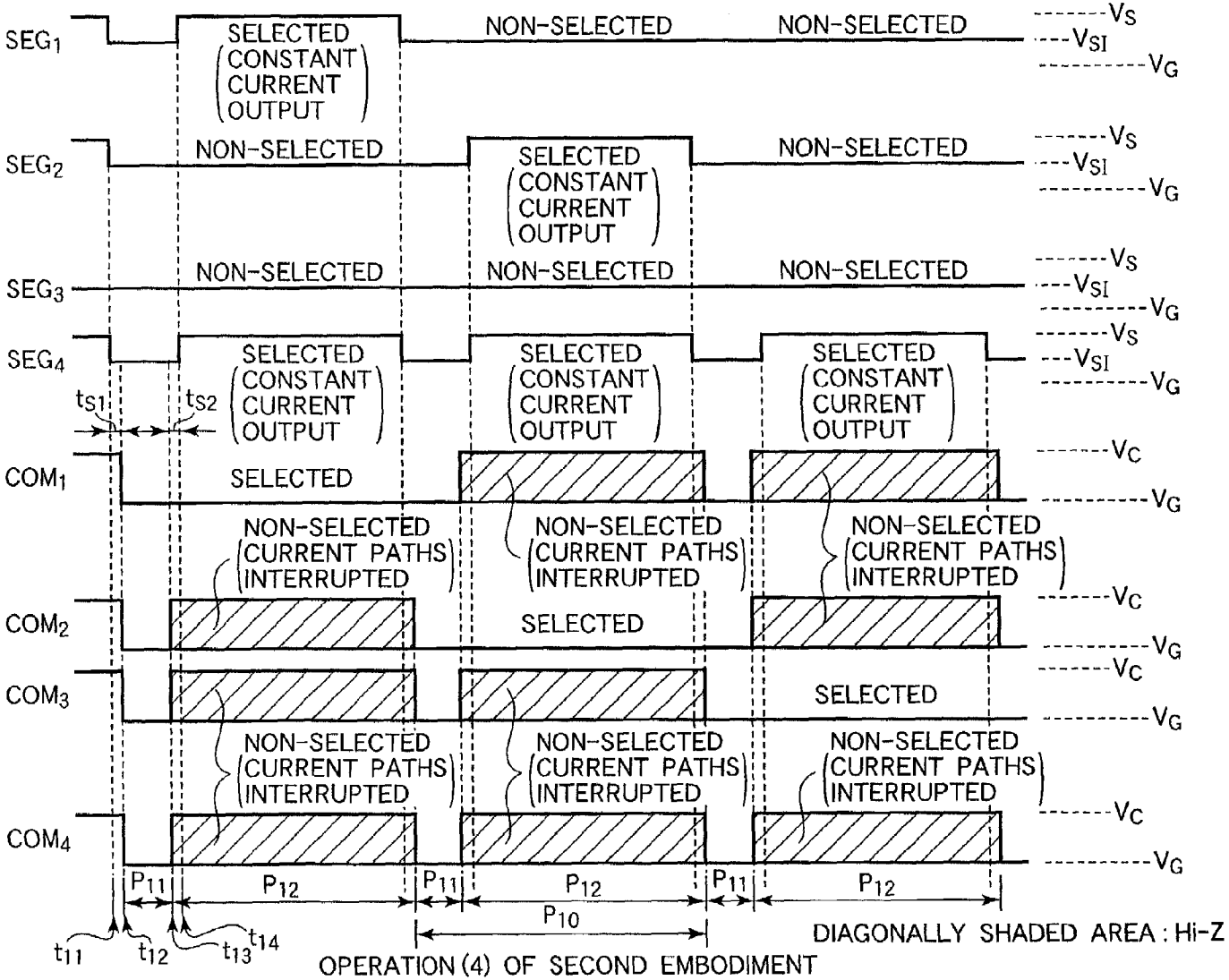
FIG. 18 is a waveform diagram showing the operation (4) of the second embodiment.
Figures 19A, 19B, 19C, 19D:
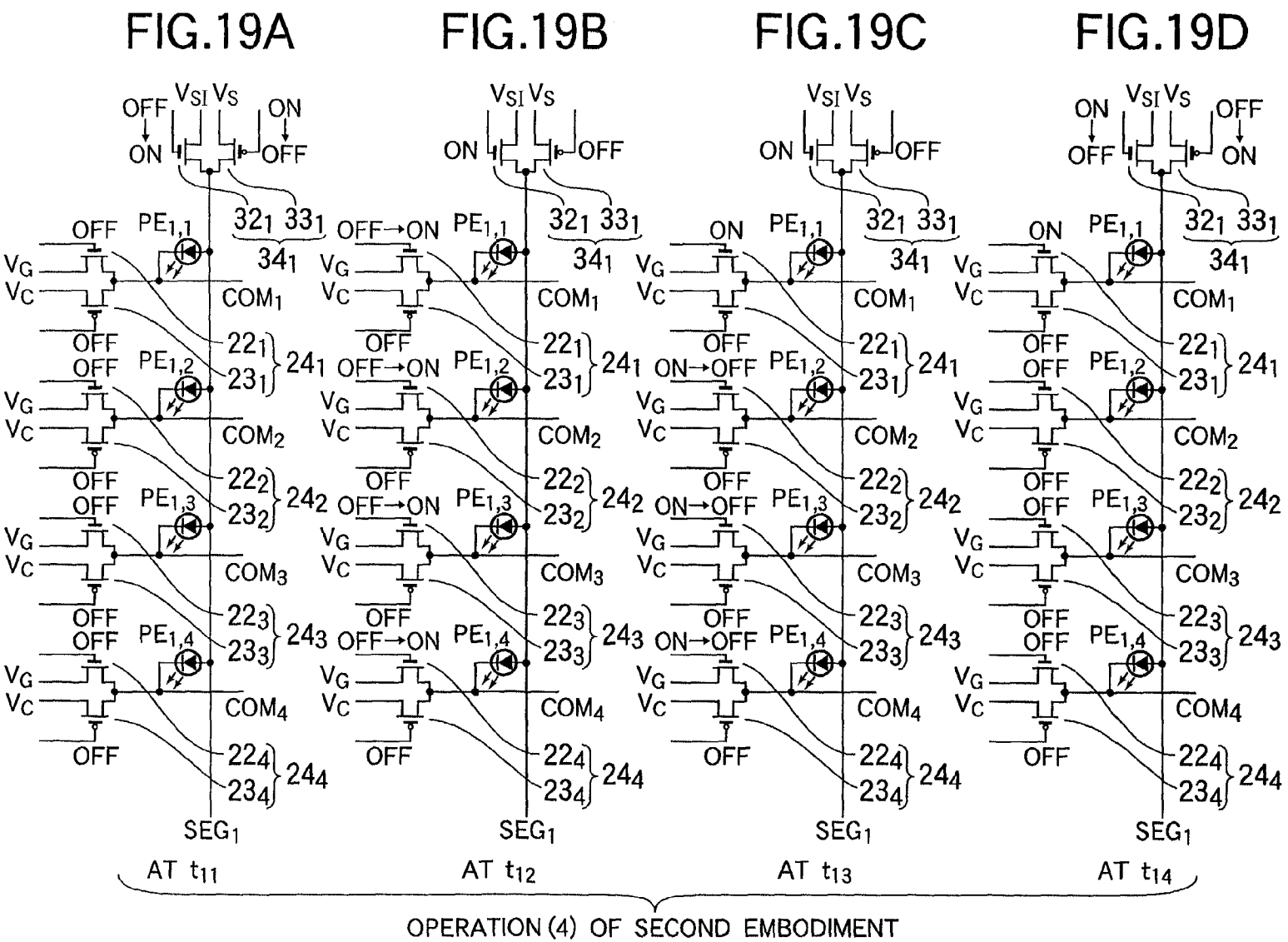
FIGS. 19A to 19D illustrate the operation (4) of the second embodiment.

FIG. 18 is a waveform diagram showing the operation (4) of the second embodiment, and FIGS. 19A to 19C illustrate the operation (4) of the second embodiment. The operation (4) of the second embodiment shown in FIG. 18 and FIGS. 19A to 19C is different from the operation (4) of the first embodiment shown earlier in FIG. 9 and FIGS. 10A to 10C in that the voltage of the non-selected data line SEG is set to the intermediate voltage $V_{SI}$ by connecting the NMOS transistor 32 of the data-line switching circuit 31 to the portion to output the intermediate voltage $V_S$ of the voltage regulator 40.

Because the non-selected data lines are set to the intermediate voltage $V_{SI}$ in the operation (4) of the second embodiment, the difference in voltage from the voltage $V_S$ of the selected data line becomes smaller than when the non-selected data lines are set to the ground voltage $V_G$, thereby reducing the "shoot-through current of the CMOS circuit 34 for data lines" incident to a reversal of the CMOS circuit 34 for data lines. In addition, the difference between the voltage $V_S$ at the selection of a data line and the voltage (intermediate voltage $V_{SI}$) of the data line in the discharge period is reduced, resulting in a faster light-emitting response. The operation (4) of the second embodiment is the same as the operation (4) of the first embodiment described earlier, except for the points described above.

<Third Embodiment>

Figure 20:
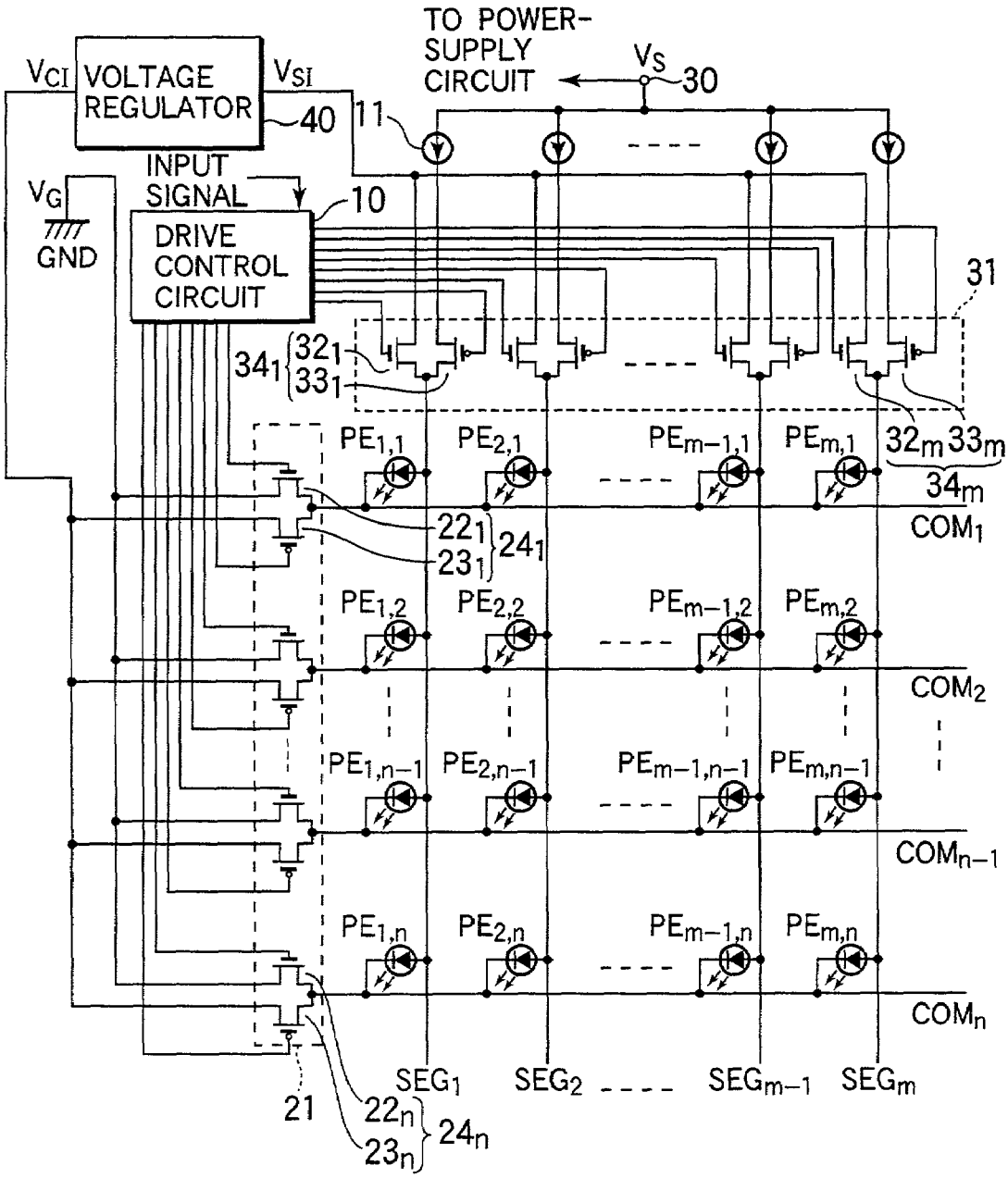
FIG. 20 is a circuit diagram showing an organic EL display device in accordance with a third embodiment of the present invention.

FIG. 20 is a circuit diagram showing an organic EL display device in accordance with a third embodiment of the present invention. In FIG. 20, the components which are the same as or equivalent to the components shown in FIG. 1 or FIG. 11 are denoted by the same references. The display device of the third embodiment has the voltage regulator 40 which supplies the intermediate voltage $V_{SI}$, which is higher than the ground voltage $V_G$ and lower than the data-line power-supply voltage $V_S$ of the high-voltage portion 30 for data lines and the intermediate voltage $V_{CI}$, which is higher than the ground voltage $V_G$ and lower than the common line power-supply voltage $V_C$ of the high-voltage portion 20 for common lines. This embodiment is different from the first and second embodiments described earlier in these points: the NMOS transistor 32 of the data-line switching circuit 31 is not connected to the ground-voltage portion GND but connected to the portion to output the intermediate voltage $V_{SI}$ of the voltage regulator 40; the NMOS transistor 22 of the common line switching circuit 21 is not connected to the common line power-supply voltage $V_C$ but connected to the portion to output the intermediate voltage $V_{CI}$ of the voltage regulator 40; and the contents of control by the drive control circuit 10. The intermediate voltages $V_{SI}$ and $V_{CI}$ supplied by the voltage regulator 40 are set so that the non-selected EL elements do not glow, that is, the voltage across the non-selected EL element does not become greater than or equal to the light-emitting threshold voltage of the EL element ($V_{SI}-V_{CI}$ does not become greater than or equal to the voltage obtained by adding the light-emitting threshold voltage of the EL element and a voltage drop by the current path). The voltage of the non-selected data line SEG and non-selected common line COM and the voltage in discharging should be set to bring the EL element to the no-bias state or reverse-biased state, so that the failure of light-emitting can be prevented.

Figure 21:
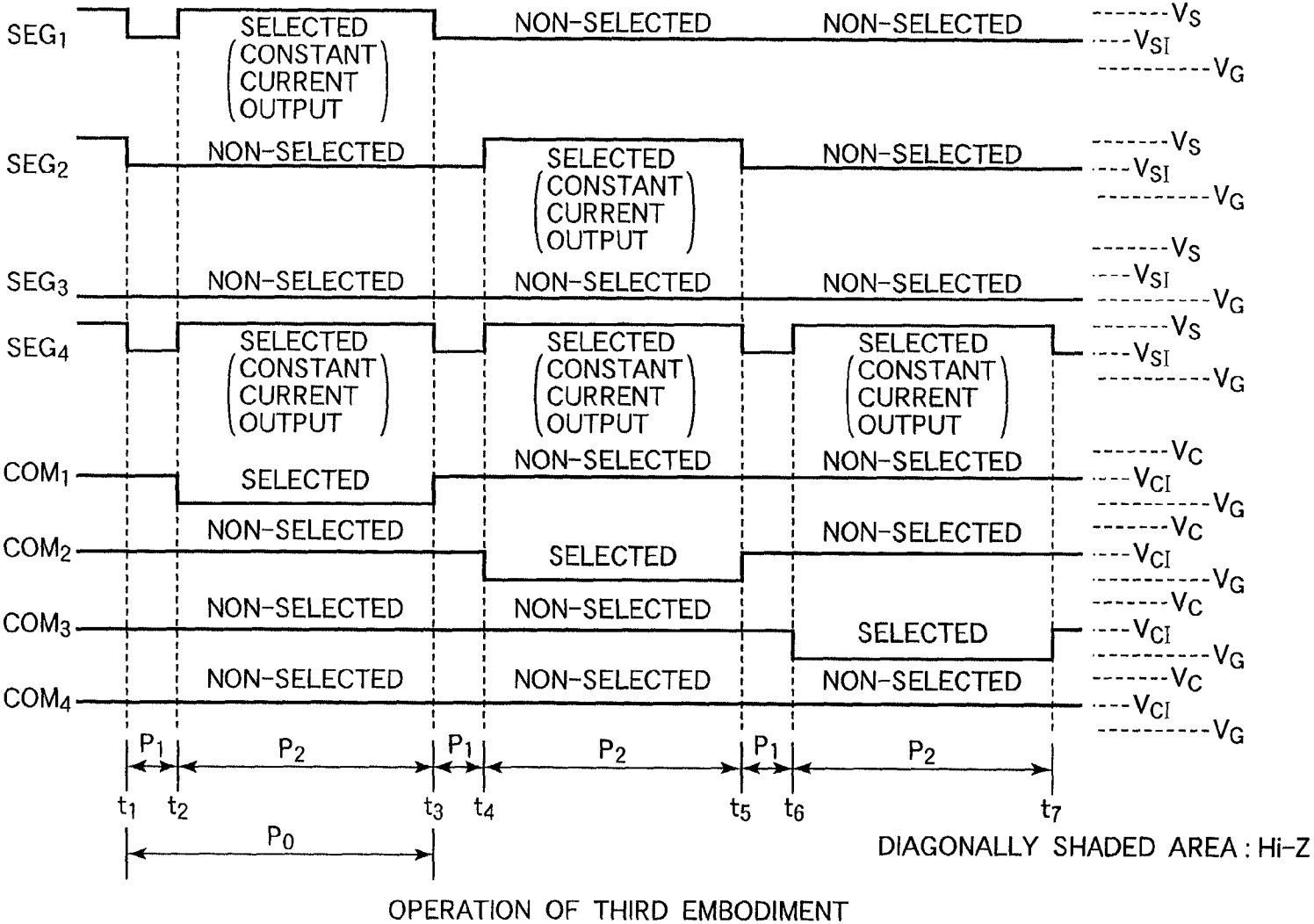
FIG. 21 is a waveform diagram showing the operation of the third embodiment.
Figures 22A, 22B, 22C:
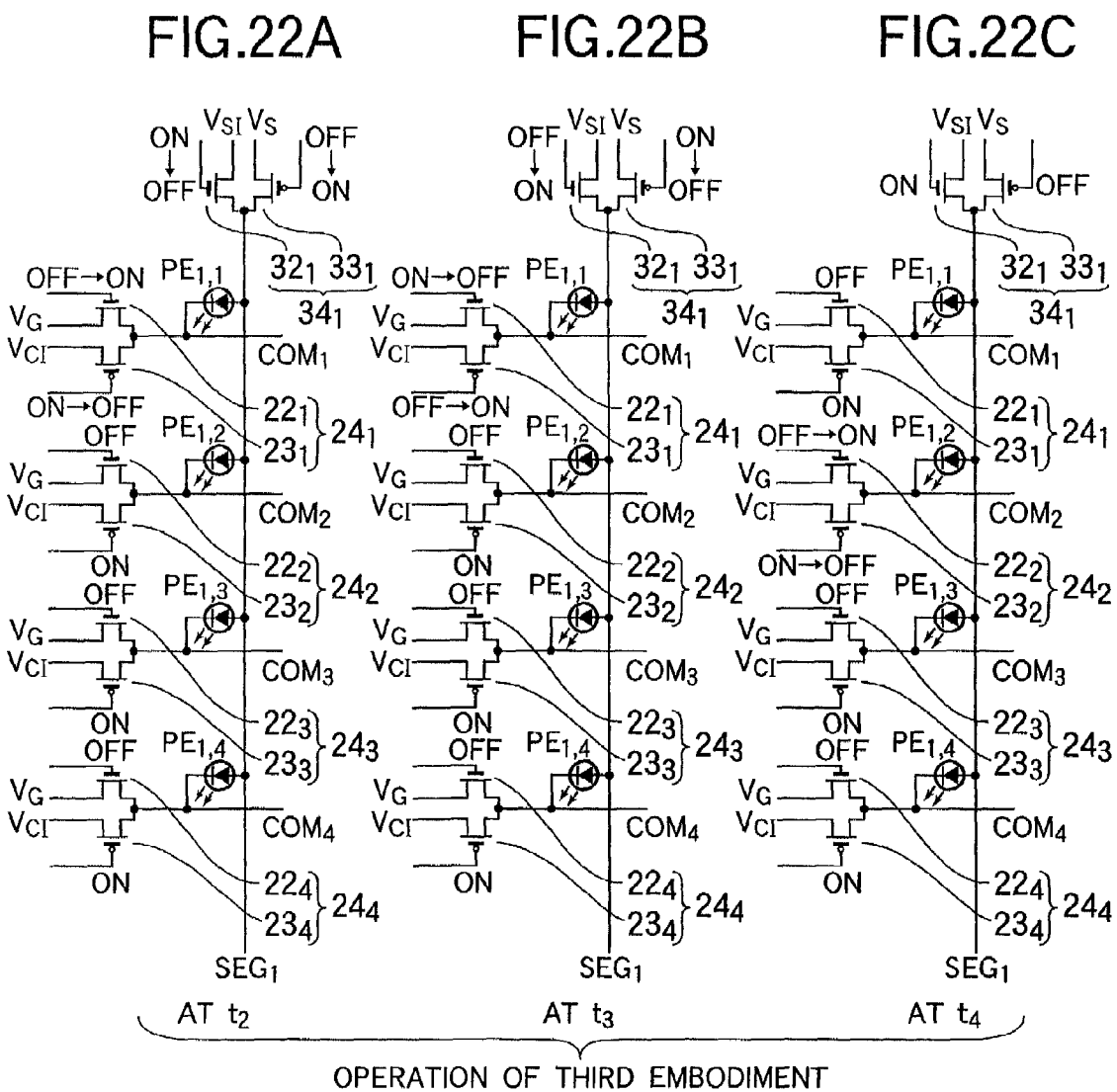
FIGS. 22A to 22C illustrate the operation of the third embodiment.

FIG. 21 is a waveform diagram showing the operation of the third embodiment, and FIGS. 22A to 22C illustrate the operation of the third embodiment. The operation of the third embodiment shown in FIG. 21 and FIGS. 22A to 22C is different from the operation (1) of the first embodiment shown earlier in FIG. 2 and FIGS. 3A to 3C in that the voltage of the non-selected data line SEG is set to the intermediate voltage $V_{SI}$ by connecting the NMOS transistor 32 of the data-line switching circuit 31 to the portion to output the intermediate voltage $V_{SI}$ of the voltage regulator 40. In addition, the operation of the third embodiment is different from the operation (1) of the first embodiment shown earlier in FIG. 2 and FIGS. 3A to 3C in that the non-selected common line COM is not brought to the Hi-Z state but set to the intermediate voltage $V_{CI}$. Moreover, the operation of the third embodiment is different from the operation (1) of the first embodiment shown earlier in FIG. 2 and FIGS. 3A to 3C in that the common line COM is not brought to the Hi-Z state but set to the intermediate voltage $V_{CI}$ in the discharge period $P_1$.

Because the non-selected data lines are set to the intermediate voltage $V_{SI}$ in the operation of the third embodiment, the difference in voltage from the voltage $V_S$ of the selected data line becomes smaller than when the non-selected data lines are set to the ground voltage $V_G$, thereby reducing the "shoot-through current of the CMOS circuit 34 for data lines" which is incident to a reversal of the CMOS circuit 34 for data lines. In addition, because the non-selected common lines are set to the intermediate voltage $V_{CI}$, the difference in voltage from the voltage $V_C$ of the selected common line becomes smaller than when the non-selected common lines are set to the ground voltage $V_G$, thereby reducing the "shoot-through current of the CMOS circuit for common lines." Moreover, the difference between the voltage of the selected or non-selected data line and common line and the voltage in the discharge period is reduced, resulting in a faster light-emitting response. In the third embodiment, the reversal timing of the CMOS circuit for data lines may be shifted as in the operation (4) of the first embodiment described earlier. The operation of the third embodiment is the same as the operation of the first embodiment or second embodiment described earlier, except for the points described above.

<Fourth Embodiment>

Figure 23:
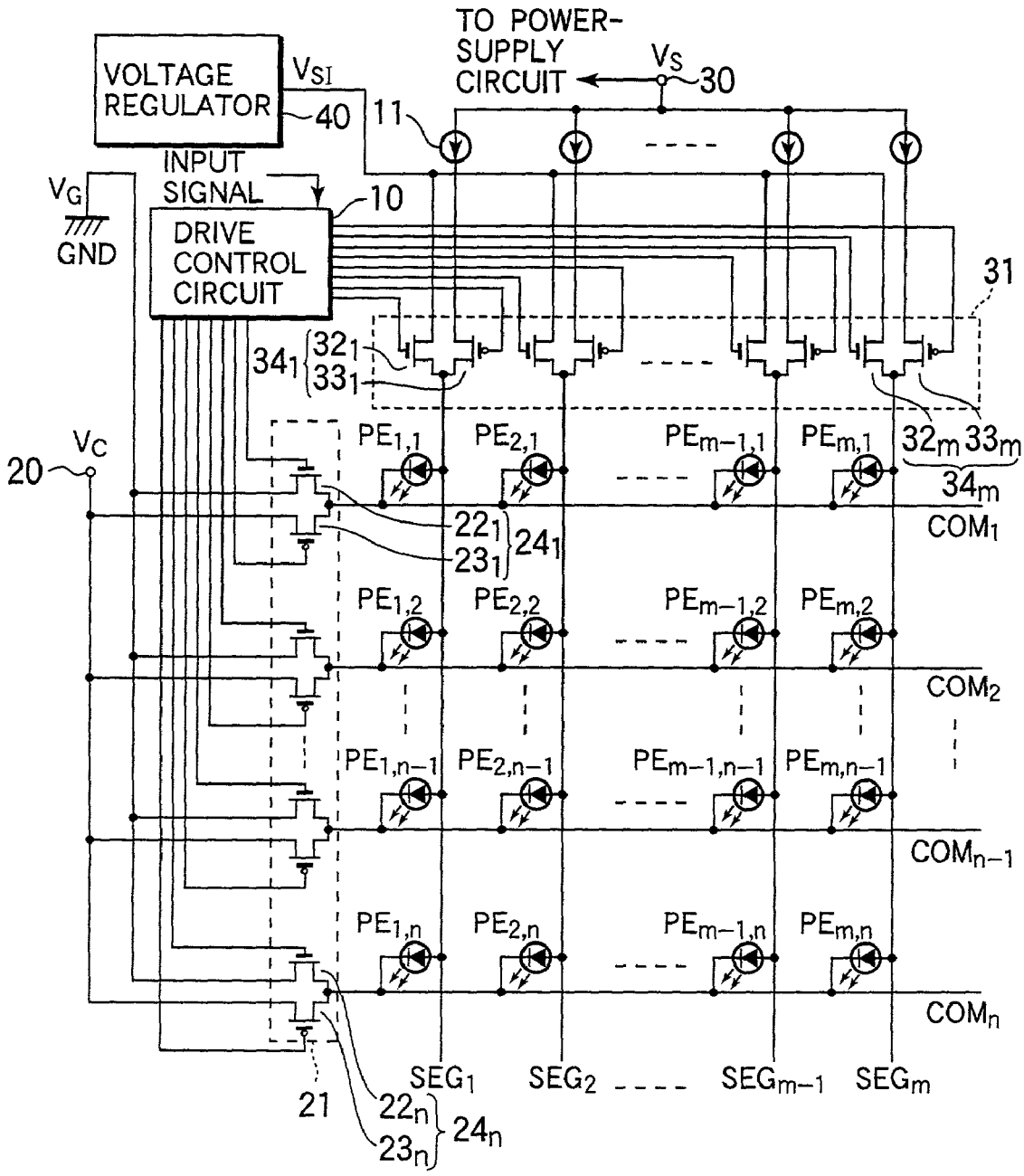
FIG. 23 is a circuit diagram showing an organic EL display device in accordance with a fourth embodiment of the present invention.
Figure 24:
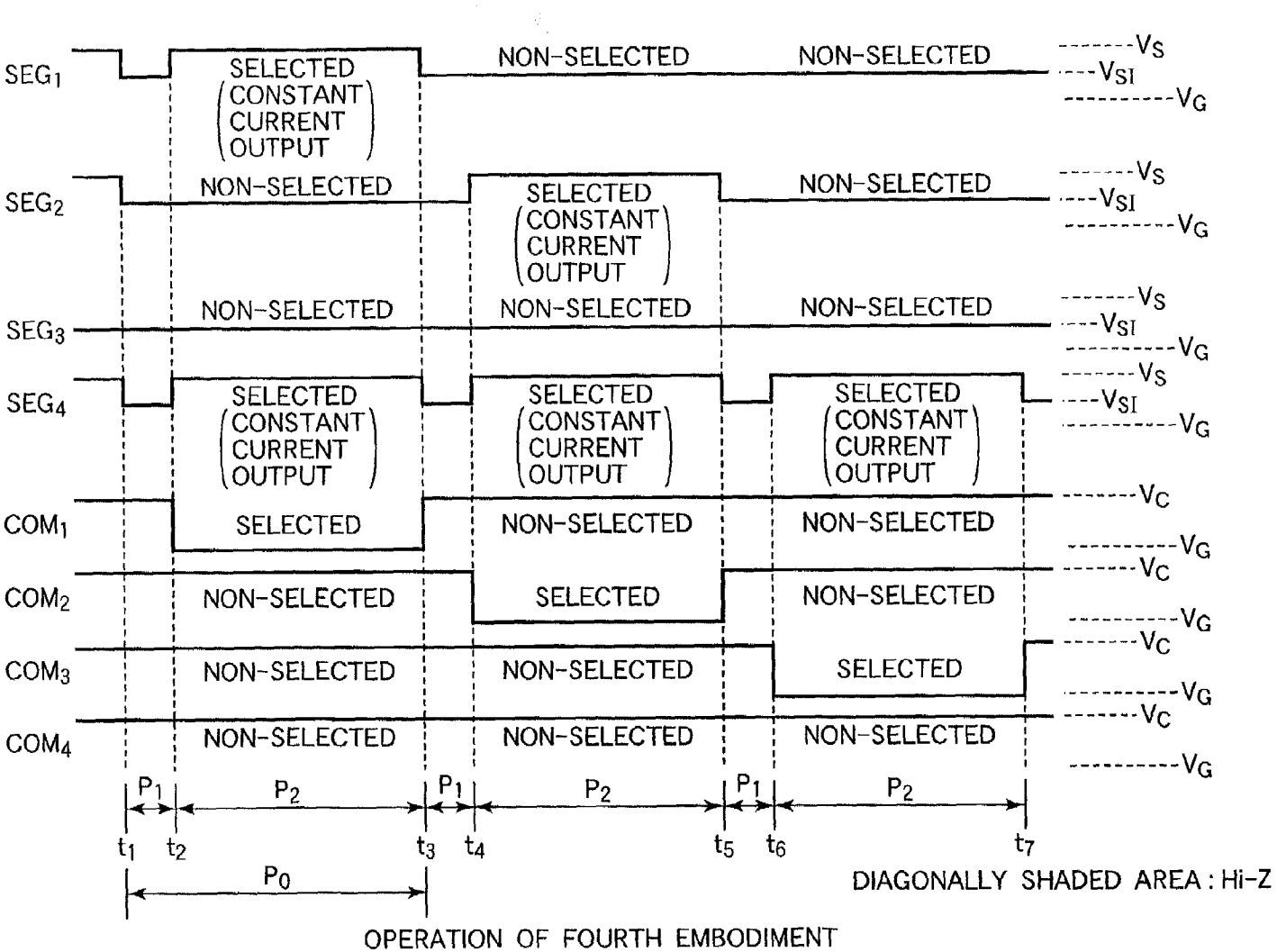
FIG. 24 is a waveform diagram showing the operation of the fourth embodiment.
Figures 25A, 25B, 25C:
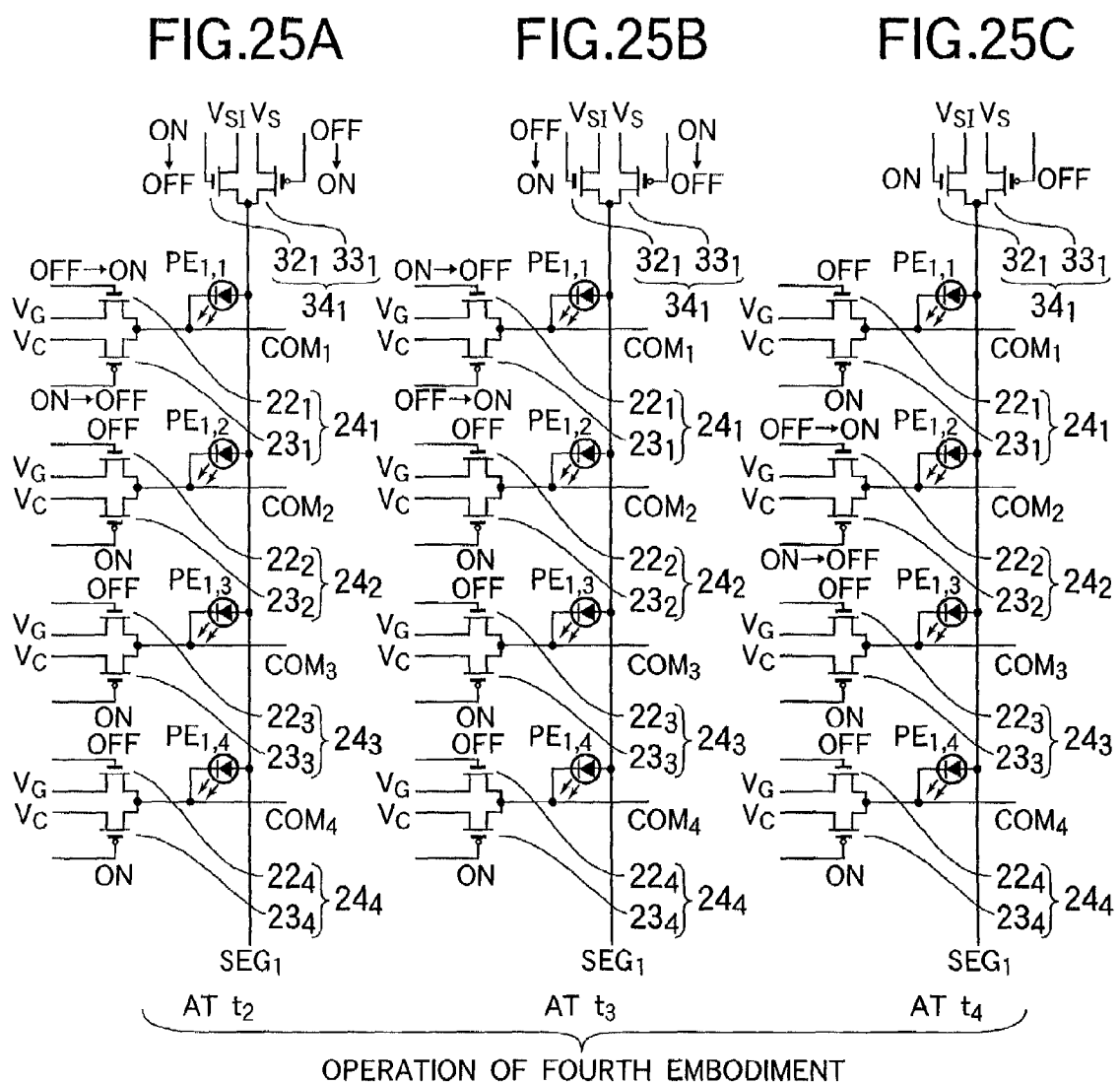
FIGS. 25A to 25C illustrate the operation of the fourth embodiment.

FIG. 23 is a circuit diagram showing an organic EL display device in accordance with a fourth embodiment of the present invention. In FIG. 23, the components which are the same as or equivalent to the components shown in FIG. 1 or FIG. 20 are denoted by the same references. FIG. 24 is a waveform diagram showing the operation of the fourth embodiment, and FIGS. 25A to 25C illustrate the operation of the fourth embodiment. The display device of the fourth embodiment is different from the third embodiment in that the power-supply voltage $V_C$ for common lines is used instead of the intermediate voltage $V_{CI}$ for common lines. In the fourth embodiment, the reversal timing of the CMOS circuit for data lines may be shifted, as in the operation (4) of the first embodiment described earlier. In addition, the operation of the fourth embodiment is the same as the third embodiment described earlier, except for the points described above.

<Fifth Embodiment>

Figure 26:
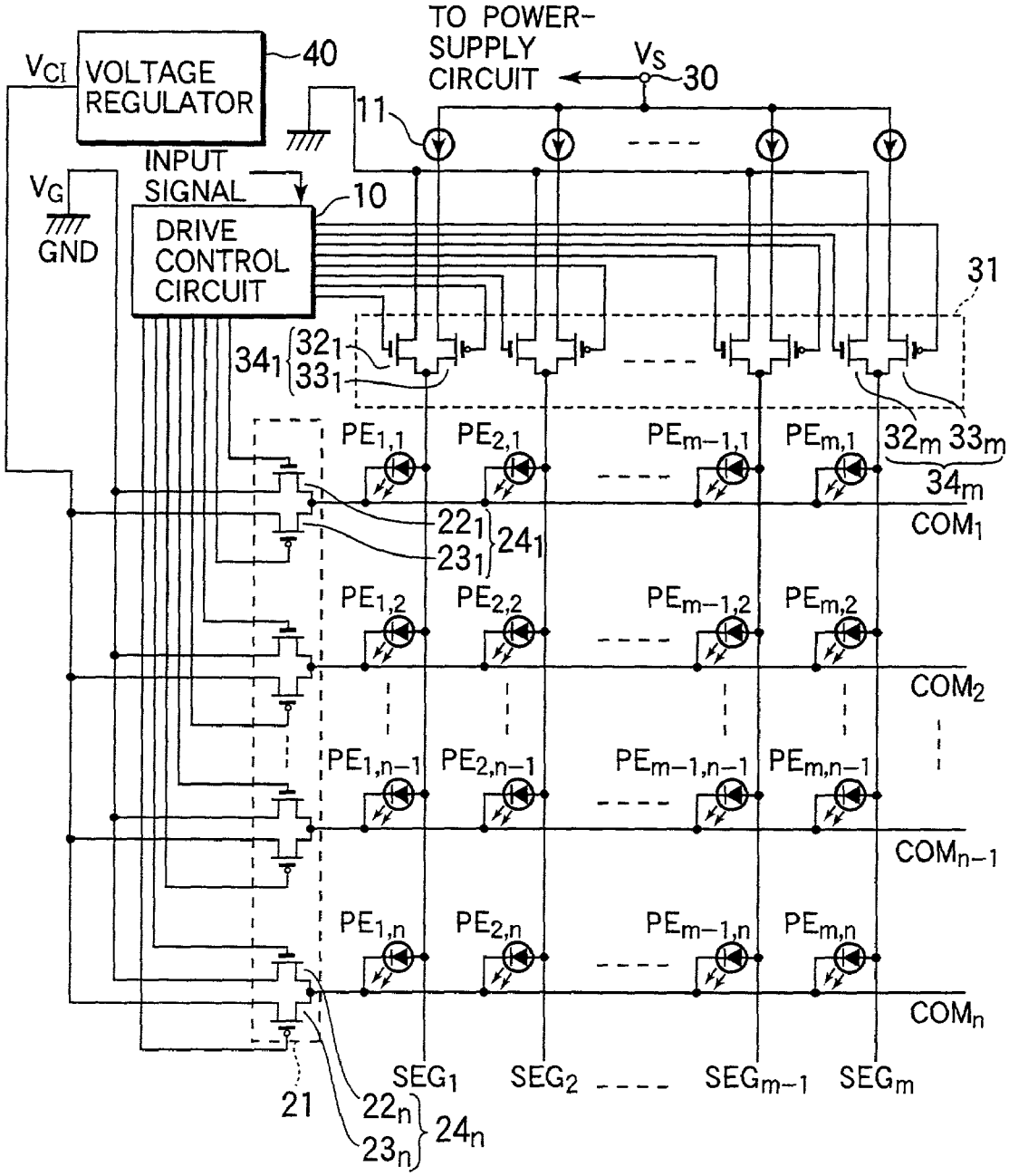
FIG. 26 is a circuit diagram showing an organic EL display device in accordance with a fifth embodiment of the present invention.
Figure 27:
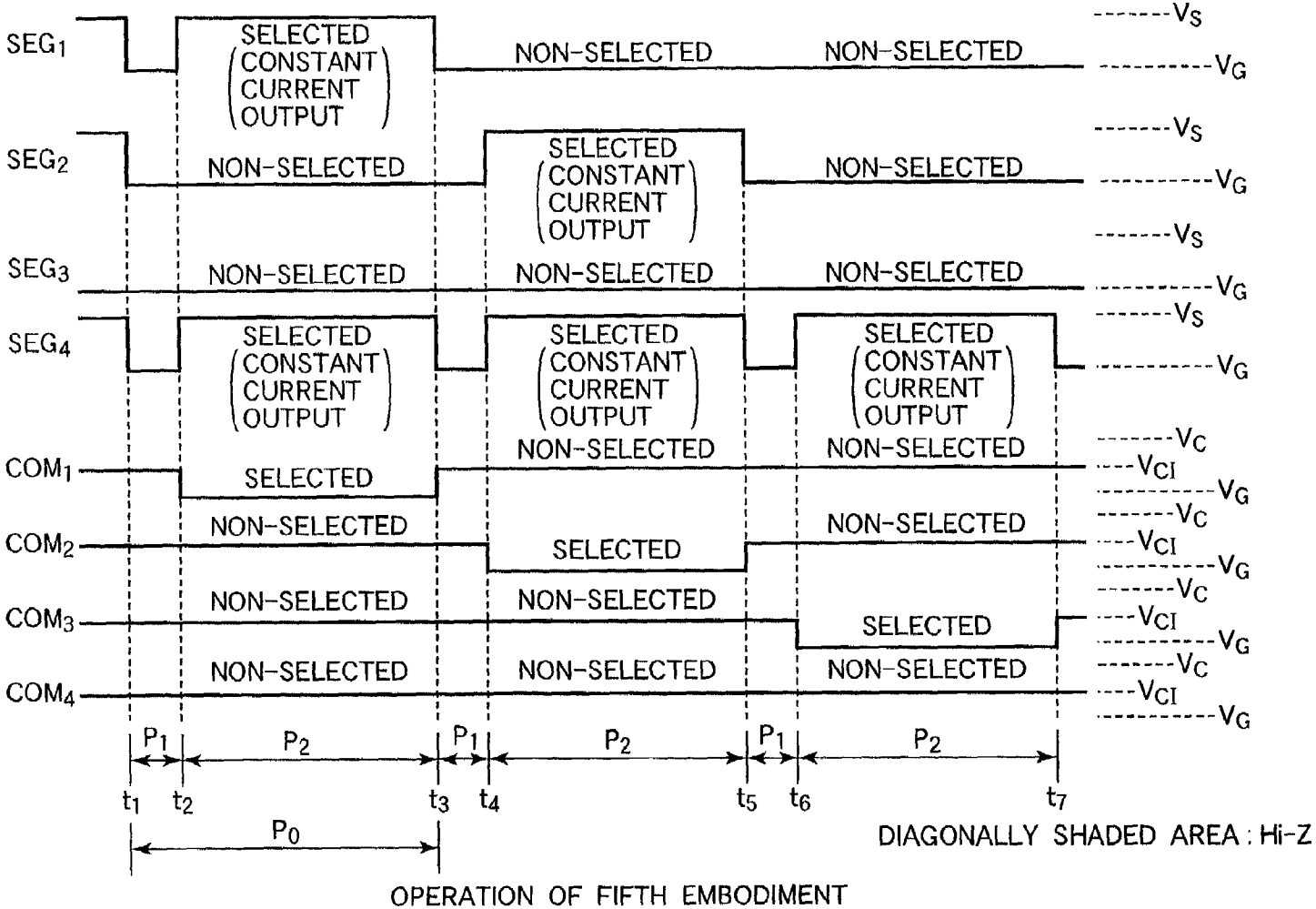
FIG. 27 is a waveform diagram showing the operation of the fifth embodiment.
Figures 28A, 28B, 28C:
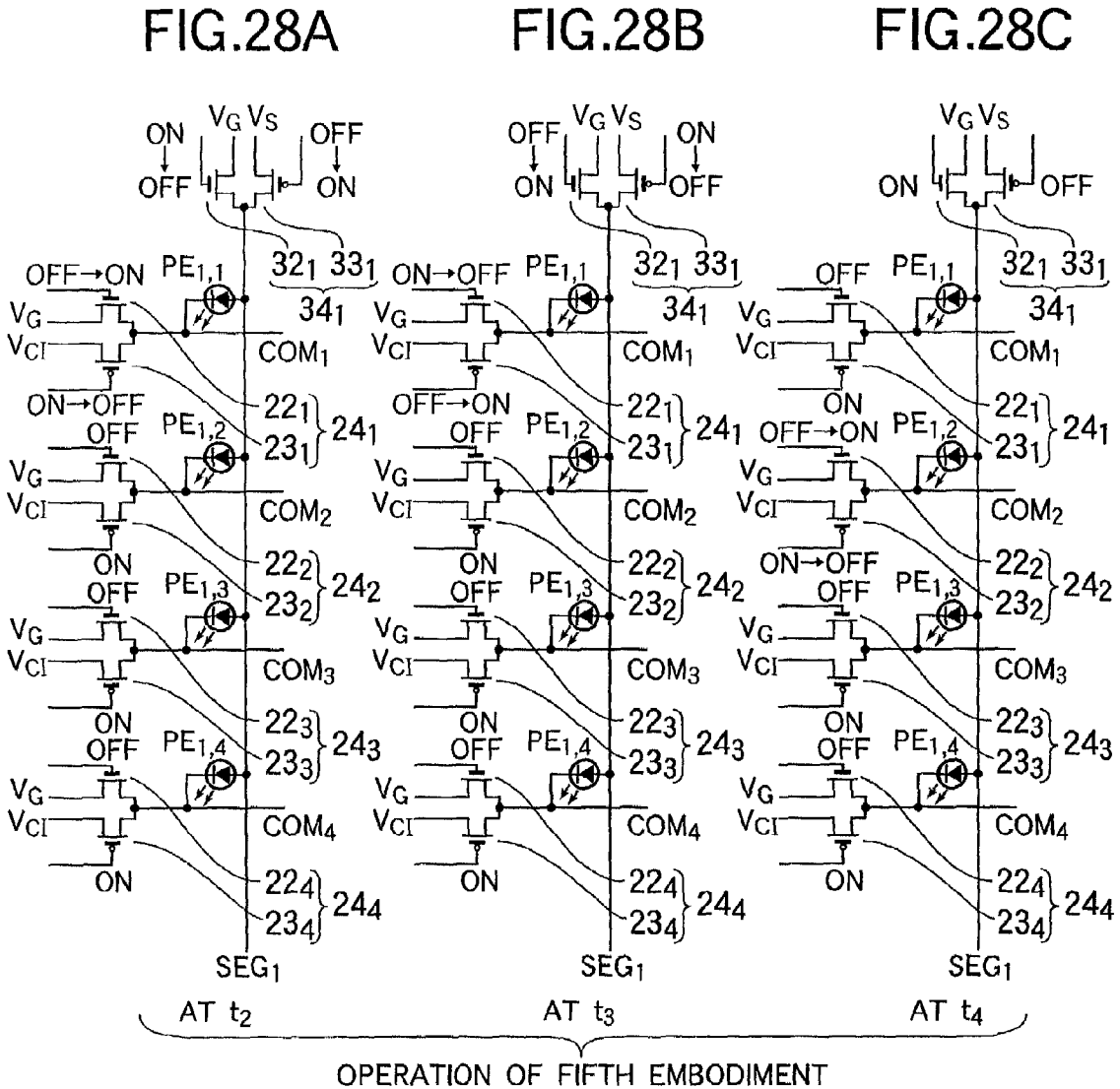
FIGS. 28A to 28C illustrate the operation of the fifth embodiment.
Figure 29:
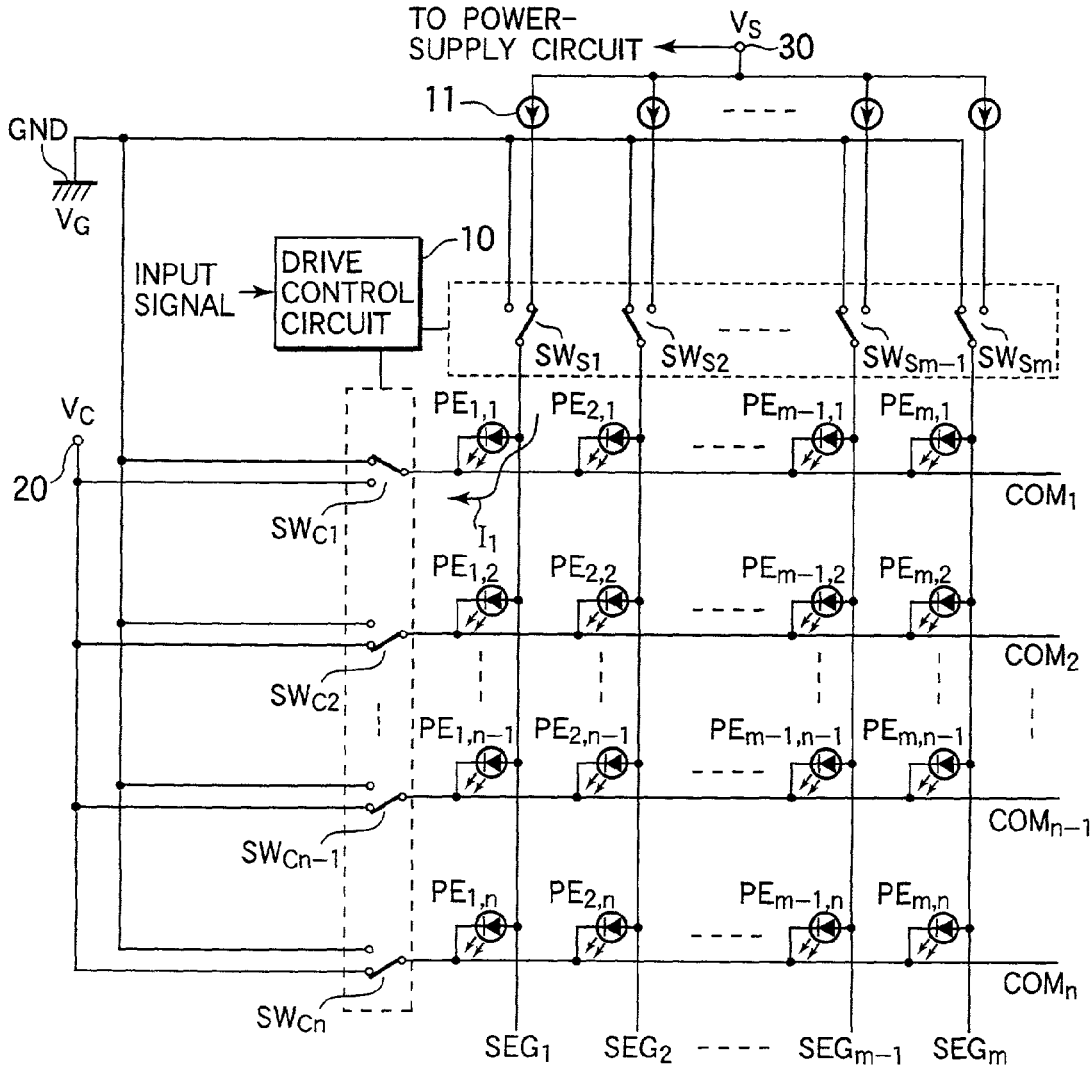
FIG.29 CONVENTIONAL ART
FIG. 29 is a circuit diagram showing a conventional display device.

FIG. 26 is a circuit diagram showing an organic EL display device in accordance with a fifth embodiment of the present invention. In FIG. 26, the components which are the same as or equivalent to the components shown in FIG. 1 or FIG. 20 are denoted by the same references. FIG. 27 is a waveform diagram showing the operation of the fourth embodiment, and FIGS. 28A to 28C illustrate the operation of the fifth embodiment. The display device of the fifth embodiment is different from the third embodiment in that the ground voltage $V_G$ is used instead of the intermediate voltage $V_{SI}$ for data lines. In the fifth embodiment, the reversal timing of the CMOS circuit for data lines may be shifted, as in the operation (4) of the first embodiment described above. The operation of the fifth embodiment is the same as the third embodiment described earlier, except for the points described above.

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. A display device comprising:

n common lines arranged in rows, where n is a positive integer;

m data lines arranged in columns, where m is a positive integer;

n×m display elements positioned at intersections of said n common lines and said m data lines;

a low-voltage portion for common lines;

a high-voltage portion for common lines, which supplies a common line power-supply voltage that is higher than a voltage supplied by said low-voltage portion for common lines;

a low-voltage portion for data lines;

a high-voltage portion for data lines, which supplies a data-line power-supply voltage that is higher than a voltage supplied by said low-voltage portion for data lines;

n first switching elements which are respectively connected to said n common lines and connect said common lines to said low-voltage portion for common lines during ON state of said n first switching elements;

n second switching elements which are respectively connected to said n common lines and connect said common lines to said high-voltage portion for common lines during ON state of said n second switching elements;

m third switching elements which are respectively connected to said m data lines and connect said data lines to said low-voltage portion for data lines during ON state of said m third switching elements; and m fourth switching elements which are respectively connected to said m data lines and connect said data lines to said high-voltage portion for data lines during ON state of said m fourth switching elements;

the display element at an intersection of a selected one of said n common lines and a selected one of said m data lines being kept at a displaying state, the selected one of said n common lines being kept at a selected state, the selected one of said m data lines being kept at a selected state;

said display device further comprising:

a drive control circuit which controls turn-on and turn-off of said n first switching elements, said n second switching elements, said m third switching elements, and said m fourth switching elements in each scan period including a display period in which the display elements are selectively brought to the displaying state and a discharge period in which electrical charge stored in the display elements is discharged;

wherein on the basis of control signals from said drive control circuit, said common line is brought to the selected state when said common line is connected to said low-voltage portion for common lines by turning on said first switching element and turning off said second switching element;

said common line is brought to a non-selected state when said common line is brought to a high-impedance state by turning off both said first switching element and said second switching element;

said data line is brought to the selected state when said data line is connected to said high-voltage portion for data lines by turning off said third switching element and turning on said fourth switching element; and said data line is brought to the non-selected state when said data line is connected to said low-voltage portion for data lines by turning on said third switching element and turning off said fourth switching element.

2. The display device according to claim 1, wherein in the discharge period, said n common lines are brought to the high-impedance state by turning off both said n first switching elements and said n second switching elements; and said m data lines are connected to said low-voltage portion for data lines by turning on said m third switching elements and by turning off said m fourth switching elements.

3. The display device according to claim 1, wherein in the discharge period, said n common lines are connected to said high-voltage portion for common lines by turning off said n first switching elements and turning on said n second switching elements; and said m data lines are connected to said low-voltage portion for data lines by turning on said m third switching elements and turning off said m fourth switching elements.

4. The display device according to claim 1, wherein in the discharge period, said n common lines are connected to said low-voltage portion for common lines by turning on said n first switching elements and by turning off said n second switching elements; and said m data lines are connected to said low-voltage portion for data lines by turning on said m third switching elements and turning off said m fourth switching elements.

5. The display device according to claim 1, wherein in the discharge period, said n common lines are connected to said low-voltage portion for common lines by turning on said n first switching elements and turning off said n second switching elements;

said m data lines are connected to said low-voltage portion for data lines by turning on said m third switching elements and turning off said m fourth switching elements immediately before a start point of the discharge period;

a state, in which said m data lines are connected to said low-voltage portion for data lines, is maintained until immediately after an end point of the discharge period; and the data line to be selected immediately after the end point of the discharge period is connected to said high-voltage portion for data lines by turning off said third switching element and turning on said fourth switching element of the data line to be selected.

6. The display device according to claim 1, further comprising:

a common line power-supply circuit which sets said high-voltage portion for common lines to the common line power-supply voltage; and a data-line power-supply circuit which sets said high-voltage portion for data lines to the data-line power-supply voltage;

said low-voltage portion for common lines being connected to ground, said low-voltage portion for data lines being connected to ground.

7. The display device according to claim 1, further comprising:

a common line power-supply circuit which sets said high-voltage portion for common lines to the common line power-supply voltage;

a data-line power-supply circuit which sets said high-voltage portion for data lines to the data-line power-supply voltage; and an intermediate-voltage portion which sets said low-voltage portion for data lines to an intermediate voltage which is higher than the ground voltage and lower than the voltage of said high-voltage portion for data lines;

said low-voltage portion for common lines being connected to ground.

8. A display device comprising:

n common lines arranged in rows, where n is a positive integer;

m data lines arranged in columns, where m is a positive integer;

n×m display elements positioned at intersections of said n common lines and said m data lines;

a low-voltage portion for common lines;

a high-voltage portion for common lines, which supplies a common line power-supply voltage that is higher than a voltage supplied by said low-voltage portion for common lines;

a low-voltage portion for data lines;

a high-voltage portion for data lines, which supplies a data-line power-supply voltage that is higher than a voltage supplied by said low-voltage portion for data lines;

n first switching elements which are respectively connected to said n common lines and connect said common lines to said low-voltage portion for common lines during ON state;

n second switching elements which are respectively connected to said n common lines and connect said common lines to said high-voltage portion for common lines during ON state of said n second switching elements;

m third switching elements which are respectively connected to said m data lines and connect said data lines to said low-voltage portion for data lines during ON state of said m third switching elements; and m fourth switching elements which are respectively connected to said m data lines and connect said data lines to said high-voltage portion for data lines during ON state of said m fourth switching elements;

the display element at an intersection of a selected one of said n common lines and a selected one of said m data lines being kept at displaying state, the selected one of said n common lines being kept at selected state, the selected one of said m data lines being kept at selected state;

said display device further comprising:

an intermediate-voltage portion which sets at least either said high-voltage portion for common lines or said low-voltage portion for data lines to an intermediate voltage which is higher than the ground voltage and lower than the common line power-supply voltage and data-line power-supply voltage; and a drive control circuit which controls the turn-on and turn-off of said n first switching elements, said n second switching elements, said m third switching elements, and said m fourth switching elements in each scan period including a display period in which display elements are selectively brought to the displaying state and a discharge period in which the charge stored in the display elements is discharged;

wherein on the basis of control signals from said drive control circuit, said common line is brought to the selected state when said common line is connected to said low-voltage portion for common lines by turning on said first switching element and turning off said second switching element;

said common line is brought to non-selected state when said common line is connected to said high-voltage portion for common lines by turning off said first switching element and turning on said second switching element;

said data line is brought to the selected state when said data line is connected to said high-voltage portion for data lines by turning off said third switching element and turning on said fourth switching element; and said data line is brought to the non-selected state when said data line is connected to said low-voltage portion for data lines by turning on said third switching element and by turning off said fourth switching element.

9. The display device according to claim 8, wherein said high-voltage portion for common lines is set to an intermediate voltage which is higher than the ground voltage and lower than the common line power-supply voltage, and said low-voltage portion for data lines is set to an intermediate voltage which is higher than the ground voltage and lower than the data-line power-supply voltage.

10. The display device according to claim 1, wherein a pair of said first switching element and said second switching element connected to the same common line is configured by a CMOS circuit; and a pair of said third switching element and said fourth switching element connected to the same data line is configured by a CMOS circuit.

11. The display device according to claim 1, wherein the common line power-supply voltage of said high-voltage portion for common lines is set to a voltage lower than the data-line power-supply voltage of said high-voltage portion for data lines.

12. A method of driving a display device, wherein said display device comprises:

n common lines arranged in rows, where n is a positive integer;

m data lines arranged in columns, where m is a positive integer;

n×m display elements positioned at intersections of said n common lines and said m data lines;

a low-voltage portion for common lines;

a high-voltage portion for common lines, which supplies a common line power-supply voltage that is higher than a voltage supplied by said low-voltage portion for common lines;

a low-voltage portion for data lines;

a high-voltage portion for data lines, which supplies a data-line power-supply voltage that is higher than a voltage supplied by said low-voltage portion for data lines;

n first switching elements which are respectively connected to said n common lines and connect said common lines to said low-voltage portion for common lines during ON state;

n second switching elements which are respectively connected to said n common lines and connect said common lines to said high-voltage portion for common lines during ON state of said n second switching elements;

m third switching elements which are respectively connected to said m data lines and connect said data lines to said low-voltage portion for data lines during ON state of said m third switching elements; and m fourth switching elements which are respectively connected to said m data lines and connect said data lines to said high-voltage portion for data lines during ON state of said m fourth switching elements;

the display element at an intersection of a selected one of said n common lines and a selected one of said m data lines being kept at displaying state, the selected one of said n common lines being kept at selected state, the selected one of said m data lines being kept at selected state;

said method comprising:

controlling the turn-on and turn-off of said n first switching elements, said n second switching elements, said m third switching elements, and said m fourth switching elements in each scan period including a display period in which the display elements are selectively brought to the displaying state and a discharge period in which electrical charge stored in the display elements is discharged;

turning on said first switching element and turning off said second switching element to connect said common line to said low-voltage portion for common lines when said common line is brought to the selected state;

turning off both said first switching element and said second switching element to bring said common line to high-impedance state when said common line is brought to non-selected state;

turning off said third switching element and turning on said fourth switching element to connect said data line to said high-voltage portion for data lines when said data line is brought to the selected state; and turning on said third switching element and turning off said fourth switching element to connect said data line to said low-voltage portion for data lines when said data line is brought to the non-selected state.

13. The method according to claim 12, wherein in the discharge period, said n common lines are brought to the high-impedance state by turning off both said n first switching elements and said n second switching elements; and said m data lines are connected to said low-voltage portion for data lines by turning on said m third switching elements and by turning off said m fourth switching elements.

14. The method according to claim 12, wherein in the discharge period, said n common lines are connected to said high-voltage portion for common lines by turning off said n first switching elements and turning on said n second switching elements; and said m data lines are connected to said low-voltage portion for data lines by turning on said m third switching elements and turning off said m fourth switching elements.

15. The method according to claim 12, wherein in the discharge period, said n common lines are connected to said low-voltage portion for common lines by turning on said n first switching elements and by turning off said n second switching elements; and said m data lines are connected to said low-voltage portion for data lines by turning on said m third switching elements and turning off said m fourth switching elements.

16. The method according to claim 12, wherein in the discharge period, said n common lines are connected to said low-voltage portion for common lines by turning on said n first switching elements and turning off said n second switching elements;

said m data lines are connected to said low-voltage portion for data lines by turning on said m third switching elements and turning off said m fourth switching elements immediately before a start point of the discharge period;

a state, in which said m data lines are connected to said low-voltage portion for data lines, is maintained until immediately after an end point of the discharge period; and the data line to be selected immediately after the end point of the discharge period is connected to said high-voltage portion for data lines by turning off said third switching element and turning on said fourth switching element of the data line to be selected.

17. The method according to claim 12, wherein said low-voltage portion for common lines is connected to ground; and said low-voltage portion for data lines is connected to ground.

18. The method according to claim 12, wherein said low-voltage portion for common lines is connected to ground; and said low-voltage portion for data lines is connected to an intermediate voltage which is higher than the ground voltage and lower than the voltage of said high-voltage portion for data lines.

19. A method of driving a display device, wherein said display device comprises:

n common lines arranged in rows, where n is a positive integer;

m data lines arranged in columns, where m is a positive integer;

n×m display elements positioned at intersections of said n common lines and said m data lines;

a low-voltage portion for common lines;

a high-voltage portion for common lines, which supplies a common line power-supply voltage that is higher than a voltage supplied by said low-voltage portion for common lines;

a low-voltage portion for data lines;

a high-voltage portion for data lines, which supplies a data-line power-supply voltage that is higher than a voltage supplied by said low-voltage portion for data lines;

n first switching elements which are respectively connected to said n common lines and connect said common lines to said low-voltage portion for common lines during ON state;

n second switching elements which are respectively connected to said n common lines and connect said common lines to said high-voltage portion for common lines during ON state of said n second switching elements;

m third switching elements which are respectively connected to said m data lines and connect said data lines to said low-voltage portion for data lines during ON state of said m third switching elements; and m fourth switching elements which are respectively connected to said m data lines and connect said data lines to said high-voltage portion for data lines during ON state of said m fourth switching elements;

the display element at an intersection of a selected one of said n common lines and a selected one of said m data lines being kept at displaying state, the selected one of said n common lines being kept at selected state, the selected one of said m data lines being kept at selected state;

said method comprising:

controlling the turn-on and turn-off of said n first switching elements, said n second switching elements, said m third switching elements, and said m fourth switching elements in each scan period including a display period in which the display elements are selectively brought to the displaying state and a discharge period in which electrical charge stored in the display elements is discharged;

setting at least either said high-voltage portion for common lines or said low-voltage portion for data lines to an intermediate voltage which is higher than the ground voltage and lower than the common line power-supply voltage and data-line power-supply voltage;

turning on said first switching element and turning off said second switching element to connect said common line to said low-voltage portion for common lines when said common line is brought to the selected state;

turning off said first switching element and turning on said second switching element to connect said common line to said high-voltage portion for common lines when said common line is brought to non-selected state;

turning off said third switching element and turning on said fourth switching element to connect said data line to said high-voltage portion for data lines when said data line is brought to the selected state; and turning on said third switching element and by turning off said fourth switching element to connect said data line to said low-voltage portion for data lines when said data line is brought to the non-selected state.

20. The method according to claim 19, wherein said high-voltage portion for common lines is set to an intermediate voltage which is higher than the ground voltage and lower than the common line power-supply voltage, and said low-voltage portion for data lines is set to an intermediate voltage which is higher than the ground voltage and lower than the data-line power-supply voltage.

21. The method according to claim 12, wherein a pair of said first switching element and said second switching element connected to the same common line is configured by a CMOS circuit; and a pair of said third switching element and said fourth switching element connected to the same data line is configured by a CMOS circuit.

22. The method according to claim 12, wherein the common line power-supply voltage of said high-voltage portion for common lines is set to a voltage lower than the data-line power-supply voltage of said high-voltage portion for data lines.

23. A driver circuit of a display device, wherein said display device comprises:

n common lines arranged in rows, where n is a positive integer;

m data lines arranged in columns, where m is a positive integer;

n×m display elements positioned at intersections of said n common lines and said m data lines;

a low-voltage portion for common lines;

a high-voltage portion for common lines, which supplies a common line power-supply voltage that is higher than a voltage supplied by said low-voltage portion for common lines;

a low-voltage portion for data lines;

a high-voltage portion for data lines, which supplies a data-line power-supply voltage that is higher than a voltage supplied by said low-voltage portion for data lines;

n first switching elements which are respectively connected to said n common lines and connect said common lines to said low-voltage portion for common lines during ON state;

n second switching elements which are respectively connected to said n common lines and connect said common lines to said high-voltage portion for common lines during ON state of said n second switching elements;

m third switching elements which are respectively connected to said m data lines and connect said data lines to said low-voltage portion for data lines during ON state of said m third switching elements; and m fourth switching elements which are respectively connected to said m data lines and connect said data lines to said high-voltage portion for data lines during ON state of said m fourth switching elements;

the display element at an intersection of a selected one of said n common lines and a selected one of said m data lines being kept at displaying state, the selected one of said n common lines being kept at selected state, the selected one of said m data lines being kept at selected state;

said driver circuit controls the turn-on and turn-off of said n first switching elements, said n second switching elements, said m third switching elements, and said m fourth switching elements in each scan period including a display period in which the display elements are selectively brought to the displaying state and a discharge period in which electrical charge stored in the display elements is discharged;

wherein on the basis of control signals from said driver circuit, said common line is brought to the selected state when said common line is connected to said low-voltage portion for common lines by turning on said first switching element and turning off said second switching element;

said common line is brought to a non-selected state when said common line is brought to a high-impedance state by turning off both said first switching element and said second switching element;

said data line is brought to the selected state when said data line is connected to said high-voltage portion for data lines by turning off said third switching element and turning on said fourth switching element; and said data line is brought to the non-selected state when said data line is connected to said low-voltage portion for data lines by turning on said third switching element and turning off said fourth switching element.

24. The driver circuit according to claim 23, wherein in the discharge period, said n common lines are brought to the high-impedance state by turning off both said n first switching elements and said n second switching elements; and said m data lines are connected to said low-voltage portion for data lines by turning on said m third switching elements and by turning off said m fourth switching elements.

25. The driver circuit according to claim 23, wherein in the discharge period, said n common lines are connected to said high-voltage portion for common lines by turning off said n first switching elements and turning on said n second switching elements; and said m data lines are connected to said low-voltage portion for data lines by turning on said m third switching elements and turning off said m fourth switching elements.

26. The driver circuit according to claim 23, wherein in the discharge period, said n common lines are connected to said low-voltage portion for common lines by turning on said n first switching elements and by turning off said n second switching elements; and said m data lines are connected to said low-voltage portion for data lines by turning on said m third switching elements and turning off said m fourth switching elements.

27. The driver circuit according to claim 23, wherein in the discharge period, said n common lines are connected to said low-voltage portion for common lines by turning on said n first switching elements and turning off said n second switching elements;

said m data lines are connected to said low-voltage portion for data lines by turning on said m third switching elements and turning off said m fourth switching elements immediately before a start point of the discharge period;

a state, in which said m data lines are connected to said low-voltage portion for data lines, is maintained until immediately after an end point of the discharge period; and the data line to be selected immediately after the end point of the discharge period is connected to said high-voltage portion for data lines by turning off said third switching element and turning on said fourth switching element of the data line to be selected.

28. The driver circuit according to claim 23, wherein said low-voltage portion for common lines is connected to ground; and said low-voltage portion for data lines is connected to ground.

29. The driver circuit according to claim 23, wherein said low-voltage portion for common lines is connected to ground; and said low-voltage portion for data lines is connected to an intermediate voltage which is higher than the ground voltage and lower than the voltage of said high-voltage portion for data lines.

30. A driver circuit of a display device, wherein said display device comprises:

n common lines arranged in rows, where n is a positive integer;

m data lines arranged in columns, where m is a positive integer;

n×m display elements positioned at intersections of said n common lines and said m data lines;

a low-voltage portion for common lines;

a high-voltage portion for common lines, which supplies a common line power-supply voltage that is higher than a voltage supplied by said low-voltage portion for common lines;

a low-voltage portion for data lines;

a high-voltage portion for data lines, which supplies a data-line power-supply voltage that is higher than a voltage supplied by said low-voltage portion for data lines;

n first switching elements which are respectively connected to said n common lines and connect said common lines to said low-voltage portion for common lines during ON state;

n second switching elements which are respectively connected to said n common lines and connect said common lines to said high-voltage portion for common lines during ON state of said n second switching elements;

m third switching elements which are respectively connected to said m data lines and connect said data lines to said low-voltage portion for data lines during ON state of said m third switching elements; and m fourth switching elements which are respectively connected to said m data lines and connect said data lines to said high-voltage portion for data lines during ON state of said m fourth switching elements;

the display element at an intersection of a selected one of said n common lines and a selected one of said m data lines being kept at displaying state, the selected one of said n common lines being kept at selected state, the selected one of said m data lines being kept at selected state;

wherein said driver circuit controls the turn-on and turn-off of said n first switching elements, said n second switching elements, said m third switching elements, and said m fourth switching elements in each scan period including a display period in which the display elements are selectively brought to the displaying state and a discharge period in which electrical charge stored in the display elements is discharged;

wherein on the basis of control signals from said drive control circuit, said common line is brought to the selected state when said common line is connected to said low-voltage portion for common lines by turning on said first switching element and turning off said second switching element;

said common line is brought to non-selected state when said common line is connected to said high-voltage portion for common lines by turning off said first switching element and turning on said second switching element;

said data line is brought to the selected state when said data line is connected to said high-voltage portion for data lines by turning off said third switching element and turning on said fourth switching element; and said data line is brought to the non-selected state when said data line is connected to said low-voltage portion for data lines by turning on said third switching element and by turning off said fourth switching element.

31. The driver circuit according to claim 30, wherein said high-voltage portion for common lines is set to an intermediate voltage which is higher than the ground voltage and lower than the common line power-supply voltage, and said low-voltage portion for data lines is set to an intermediate voltage which is higher than the ground voltage and lower than the data-line power-supply voltage.

32. The driver circuit according to claim 23, wherein a pair of said first switching element and said second switching element connected to the same common line is configured by a CMOS circuit; and a pair of said third switching element and said fourth switching element connected to the same data line is configured by a CMOS circuit.

33. The driver circuit according to claim 23, wherein the common line power-supply voltage of said high-voltage portion for common lines is set to a voltage lower than the data-line power-supply voltage of said high-voltage portion for data lines.

* * * * *